US011384294B1

(12) United States Patent
Fathi et al.

(10) Patent No.: US 11,384,294 B1
(45) Date of Patent: Jul. 12, 2022

(54) SYSTEMS AND PROCESSES FOR TREATING DISULFIDE OIL

(71) Applicant: Saudi Arabian Oil Company, Dhahran (SA)

(72) Inventors: Mazin M. Fathi, Dammam (SA); Ki-Hyouk Choi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/140,352

(22) Filed: Jan. 4, 2021

(51) Int. Cl.
*C10G 45/02* (2006.01)
*C10G 67/02* (2006.01)

(52) U.S. Cl.
CPC ..... *C10G 45/02* (2013.01); *C10G 67/02* (2013.01); *C10G 2300/202* (2013.01); *C10G 2300/205* (2013.01); *C10G 2300/206* (2013.01); *C10G 2300/207* (2013.01); *C10G 2300/301* (2013.01); *C10G 2300/302* (2013.01); *C10G 2300/308* (2013.01)

(58) Field of Classification Search
CPC .. C10G 45/02; C10G 67/02; C10G 2300/301; C10G 2300/302; C10G 2300/207; C10G 2300/308; C10G 2300/205; C10G 2300/206; C10G 2300/202
See application file for complete search history.

(56) References Cited

U.S. PATENT DOCUMENTS 4,110,192 A 8/1978 Hildebrand et al.
4,127,393 A 11/1978 Timmins et al.
4,128,471 A 12/1978 Malone et al.
4,209,305 A 6/1980 Conway et al.
4,214,977 A 7/1980 Ranganathan et al.
8,535,518 B2 9/2013 Choi et al.
8,864,978 B2 10/2014 Choi
9,382,485 B2 7/2016 Choi et al.
10,011,790 B2 7/2018 Choi et al.
10,106,748 B2 10/2018 Choi et al.
10,723,962 B2 7/2020 Choi et al.
10,752,847 B2 8/2020 Choi et al.
2009/0206006 A1 8/2009 Allam
2011/0049016 A1 3/2011 Mcgrady et al.
(Continued)

OTHER PUBLICATIONS

Hao et al, Theoretical Study on the Mechanism of Hydrogen Donation and Transfer for Hydrogen-Donor Solvents during Direct Coal Liquefaction, 2018, Catalysts, 8, 648 pp. 1-10 (Year: 2018).*
(Continued)

*Primary Examiner* — Randy Boyer
*Assistant Examiner* — Juan C Valencia
(74) *Attorney, Agent, or Firm* — Dinsmore & Shohl LLP

(57) ABSTRACT

A process for treating a disulfide oil composition that includes combining a supercritical water stream, a hydrogen stream, and a disulfide oil composition in a mixing device to create a combined disulfide feed stream; introducing the combined disulfide feed stream into a supercritical water hydrogenation reactor operating at a temperature greater than a critical temperature of water and a pressure greater than a critical pressure of water; and at least partially converting the combined disulfide feed stream to an upgraded disulfide product.

10 Claims, 2 Drawing Sheets

(56) References Cited

U.S. PATENT DOCUMENTS

| | | | | |
|---|---|---|---|---|
| 2012/0061291 | A1* | 3/2012 | Choi | C10G 49/22 208/53 |
| 2019/0249096 | A1 | 8/2019 | Choi et al. | |
| 2019/0264110 | A1* | 8/2019 | Choi | C10G 67/06 |
| 2019/0270642 | A1 | 9/2019 | Leroi et al. | |
| 2020/0180953 | A1 | 6/2020 | Koseoglu | |
| 2020/0224105 | A1 | 7/2020 | Choi et al. | |

OTHER PUBLICATIONS

Batsanov, "Van der Waals Radii of Elements", Inorganic Materials, vol. 37, No. 98, pp. 871-885, 2001.
Cudmore, "Non-Catalytic Hydrogenation of Australian Coals", Fuel Processing Technology, vol. 1, pp. 227-241, 1977.
Koseoglu et al., "Kinetics of non-catalytic hydrocracking of Athabasca bitumen", Fuel, vol. 66, pp. 741-748, Jun. 1987.
Koseoglu et al., "Hydrocracking of Athabasca bitumen—Kinetics of formation of gases", Fuel, vol. 67, pp. 552-556, Apr. 1988.
Koseoglu et al., "Kinetic models for the non-catalytic hydrocracking of Athabasca bitumen", Fuel, vol. 67, pp. 906-915, Jul. 1988.
Morgott et al., "Disulfied Oil Hazard Assessment Using Categorical Analysis of a Mode of Action Determination", International Journal of Toxicology, vol. 33, Suplement 1, pp. 181S-198S, 2014.
Soodhoo et al., "Non-catalytic hydrocracking of asphaltenes—1. Product distributions", Fuel, vol. 67, pp. 361-374, Mar. 1988.
Soodhoo et al., "Non-catalytic hydrocracking of asphaltenes—2. Reaction kinetics", Fuel, vol. 67, pp. 521-529, Apr. 1988.
Yan, "Characterization of visbreaker feeds", Fuel, vol. 69, pp. 1062-1064, Aug. 1990.
U.S. Office Action dated Jul. 22, 2021 pertaining to U.S. Appl. No. 17/140,323, filed Jan. 4, 2021, 14 pages.
International Search Report and Written Opinion dated Dec. 13, 2021 pertaining to International application No. PCT/US2021/052363 filed Sep. 28, 2021, 12 pages.
International Search Report and Written Opinion dated Sep. 29, 2021 pertaining to International application No. PCT/US2021/029593 filed Apr. 28, 2021, 12 pages.

* cited by examiner

SYSTEMS AND PROCESSES FOR TREATING DISULFIDE OIL

TECHNICAL FIELD

Embodiments of the present disclosure generally relate to upgrading petroleum-based compositions, and more specifically relate to supercritical reactor systems, methods, and uses for upgrading petroleum-based compositions.

BACKGROUND

Petroleum is an indispensable source of energy; however, most petroleum is heavy or sour petroleum, meaning that it contains a high amount of impurities (including sulfur and coke, a high carbon petroleum residue). Heavy petroleum must be upgraded before it is a commercially valuable product, such as fuel. Supercritical water has been known to be an effective reaction medium for heavy oil upgrading without external supply of hydrogen, at least because supercritical water upgrading reactions are highly selective towards breaking of heavy fractions to produce middle distillate oils without coke generation.

SUMMARY

Although supercritical water has been known to be an effective reaction medium for heavy oil upgrading without an external supply of hydrogen, the upgraded product from a supercritical water process has a greater aromaticity and olefinicity than the hydrocarbon feed, which has negative effect on the stability of the products. Nuclear magnetic resonance (NMR) analysis has shown that the asphaltene content of supercritical water treated oil decreased to a large extent, while saturate, olefin, and aromatic content increased. Additionally, the extent of hydrocarbon upgrading in conventional supercritical water upgrading processes may be limited. The high temperature of supercritical water reactor induces thermal cracking of chemical bonds such as carbon-sulfur bonds and carbon-carbon bonds. Broken bonds should be filled with other atoms, preferably hydrogen, to avoid intermolecular condensation and generation of olefins and polycondensed aromatics. Although olefins are very valuable chemicals, the low stability of unsaturated bonds can degrade products by forming gums. The hydrogen inherently present in the water molecules can participate in the cracking reaction, but the extent of hydrogen donation from water is quite limited in supercritical water conditions due to high hydrogen-oxygen bond energy.

Accordingly, a need exists for a hydrocarbon upgrading process that incorporates the benefits of conventional supercritical water upgrading processes, while decreasing the large hydrocarbon radicals and olefins that are hydrothermally generated by supercritical water. The present disclosure addresses this need by incorporating hydrogen addition into the supercritical water hydrocarbon upgrading process.

Hydrogen addition into the supercritical water process provides additional yields of middle distillate oils but at improved stability by saturating heavy hydrocarbon radicals and olefins that have potential to generate gums. In addition, the supercritical water process breaks large asphaltene aggregates, such as aggregates with a size from 1 to 800 microns (μm), to much smaller scattered radical aggregates, such as aggregates with a size from 0.1 to 300 nanometers (nm) that can readily be saturated by hydrogen due to its small size (1.06-1.20 angstrom). This in turn reduces the asphaltene content in the oil by converting them into lighter fractions. Therefore, supercritical water facilitates the hydrogenation of heavy hydrocarbon radicals including olefin and alphaltene radicals and prevents their combination reactions that terminate the upgrading reaction mechanism. In other words, the hydrogen addition to the supercritical water process passivates the combination reactions of large hydrocarbon radicals and olefins that are hydrothermally generated by supercritical water, thereby preventing gum, asphaltene, and coke generation, which allows for increasing process severity for additional oil upgrading.

In accordance with one embodiment of the present disclosure, a process for treating a disulfide oil composition is provided. The process includes combining a supercritical water stream, a hydrogen stream, and a disulfide oil composition in a mixing device to create a combined disulfide feed stream; introducing the combined disulfide feed stream into a supercritical water hydrogenation reactor operating at a temperature greater than a critical temperature of water and a pressure greater than a critical pressure of water; and at least partially converting the combined disulfide feed stream to an upgraded disulfide product.

BRIEF DESCRIPTION OF THE DRAWINGS

The following detailed description of specific embodiments of the present disclosure can be best understood when read in conjunction with the following drawings, in which.

DETAILED DESCRIPTION

Figure 1:
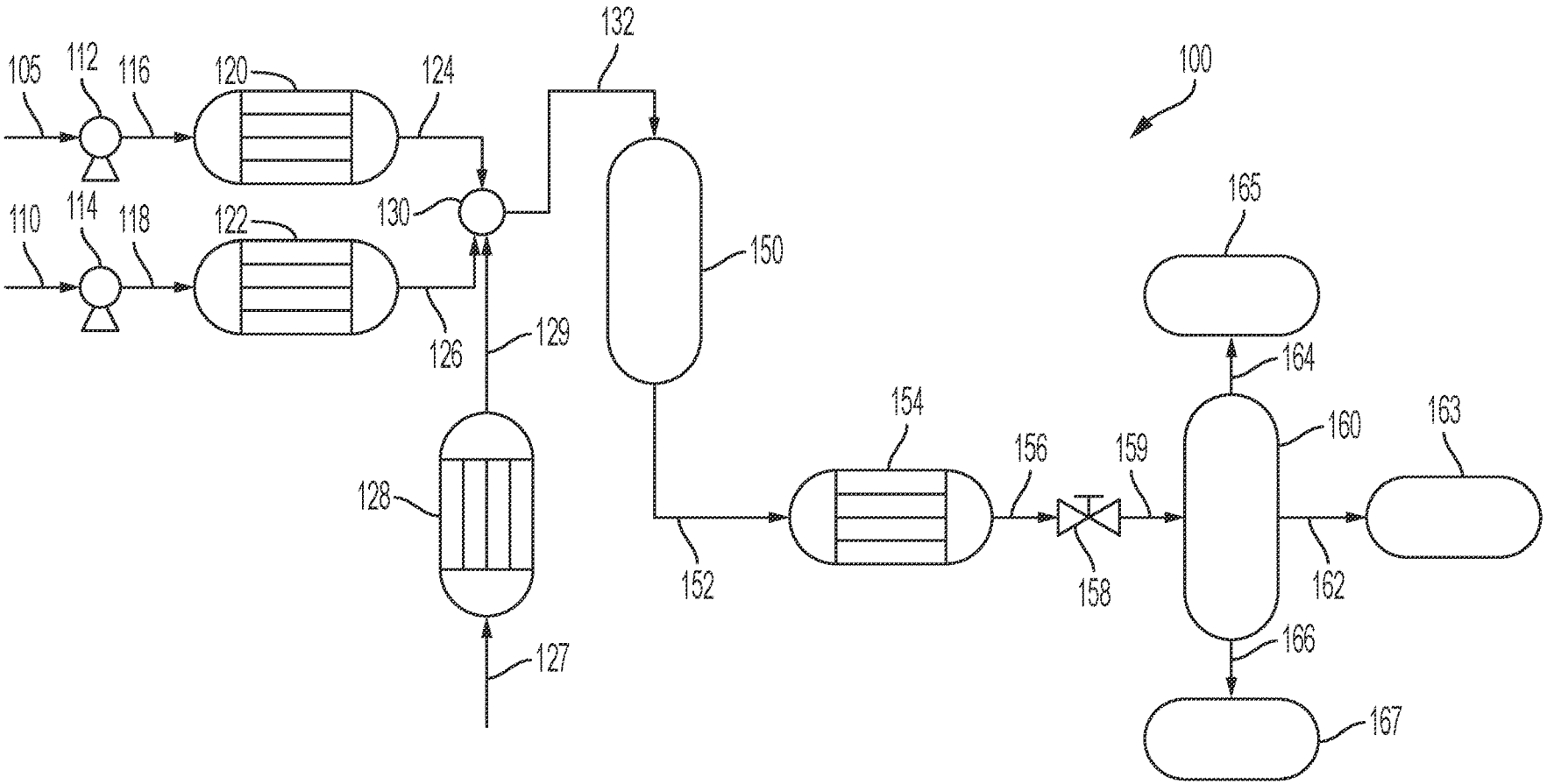
FIG. 1 is a schematic view of a process for upgrading a hydrocarbon-based composition, according to the present embodiments.

Embodiments of the present disclosure are directed to processes for upgrading hydrocarbon streams in a supercritical water hydrogenation reactor.

As used throughout the disclosure, "supercritical" refers to a substance at or above a pressure and a temperature greater than or equal to that of its critical pressure and temperature, such that distinct phases do not exist and the substance may exhibit the fast diffusion of a gas while dissolving materials like a liquid. As such, supercritical water is water having a temperature and pressure greater than or equal to the critical temperature and the critical pressure of water. At a temperature and pressure greater than or equal to the critical temperature and pressure, the liquid and gas phase boundary of water disappears, and the fluid has characteristics of both liquid and gaseous substances. Supercritical water is able to dissolve organic compounds like an organic solvent and has excellent diffusibility like a gas. Regulation of the temperature and pressure allows for continuous "tuning" of the properties of the supercritical water to be more liquid-like or more gas-like. Supercritical water has reduced density and lesser polarity, as compared to liquid-phase subcritical water, thereby greatly extending the possible range of chemistry that can be carried out in water. Water above its critical condition is neither a liquid nor gas but a single fluid phase that converts from being polar to non-polar.

As used throughout the disclosure, "upgrade" means to increase the API gravity, decrease the amount of impurities, such as sulfur, nitrogen, and metals, decrease the amount of asphaltene, and increase the amount of the light fraction.

Supercritical water has various unexpected properties as it reaches supercritical boundaries. Supercritical water has very high solubility toward organic compounds and has an infinite miscibility with gases. Furthermore, radical species can be stabilized by supercritical water through the cage effect (that is, a condition whereby one or more water molecules surrounds the radical species, which then prevents the radical species from interacting). Without being limited to theory, stabilization of radical species helps prevent inter-radical condensation and thereby reduces the overall coke production in the current embodiments. For example, coke production can be the result of the inter-radical condensation. In certain embodiments, supercritical water generates hydrogen gas through a steam reforming reaction and water-gas shift reaction, which is then available for the upgrading reactions.

Moreover, the high temperature and high pressure of supercritical water may give supercritical water a density of 0.123 grams per milliliter (g/mL) at 27 MPa and 450° C. Contrastingly, if the pressure was reduced to produce superheated steam, for example, at 20 MPa and 450° C., the superheated steam would have a density of only 0.079 g/mL. At that density, the hydrocarbons may interact with superheated steam to evaporate and mix into the vapor phase, leaving behind a heavy fraction that may generate coke upon heating. The formation of coke or coke precursor may plug the lines and must be removed. Therefore, supercritical water is superior to steam in some applications.

Specific embodiments will now be described with references to the figures. Whenever possible, the same reference numerals will be used throughout the drawings to refer to the same or like parts.

FIG. 1 schematically depicts a process 100 for upgrading a hydrocarbon-based composition 105, according to embodiments described herein.

The hydrocarbon-based composition 105 may refer to any hydrocarbon source derived from petroleum, coal liquid, or biomaterials. Possible sources for hydrocarbon-based composition may include crude oil, distilled crude oil, reduced crude oil, residue oil, topped crude oil, product streams from oil refineries, product streams from steam cracking processes, liquefied coals, liquid products recovered from oil or tar sands, bitumen, oil shale, asphaltene, biomass hydrocarbons, and the like. Many compositions are suitable for the hydrocarbon-based composition. In some embodiments, the hydrocarbon-based composition 105 may comprise heavy crude oil or a fraction of heavy crude oil. In other embodiments, the hydrocarbon-based composition 105 may include atmospheric residue (AR), atmospheric distillates, vacuum gas oil (VGO), vacuum distillates, or vacuum residue (VR), or cracked product (such as light cycle oil or coker gas oil). In some embodiments, the hydrocarbon-based composition may be combined streams from a refinery, produced oil, or other hydrocarbon streams, such as from an upstream operation. The hydrocarbon-based composition 105 may be decanted oil, oil containing 10 or more carbons (C10+ oil), or hydrocarbon streams from an ethylene plant. The hydrocarbon-based composition 105 may, in some embodiments, be liquefied coal or biomaterial-derivatives, such as bio fuel oil. In some embodiments, used lubrication (lube) oil or brake fluids may be used.

The hydrocarbon-based composition 105 may, in some embodiments, be naphtha or kerosene or diesel fractions. Such fractions may be used but may not be upgraded as efficiently by the supercritical water. Contaminated hydrocarbon fractions may also be used. In some embodiments, fractions with saltwater contamination may be used as the hydrocarbon-based composition 105. For instance, crude oil in market typically has a salt content below about 10 PTB (pounds of salt per 1000 barrels of oil). The salt in saltwater may be precipitated by the supercritical water to produce a desalted product, which may be desirable in some embodiments.

The hydrocarbon-based composition 105 may have a $T_5$ true boiling point (TBP) of less than 500° C., of less than 450° C., of less than 400° C., of less than 380° C., or of less than 370° C. In embodiments, the hydrocarbon-based composition 105 may have a $T_5$ TBP of from 200° C. to 500° C., from 200° C. to 450° C., from 200° C. to 425° C., from 200° C. to 400° C., from 200° C. to 380° C., from 200° C. to 370° C., from 250° C. to 500° C., from 250° C. to 450° C., from 250° C. to 425° C., from 250° C. to 400° C., from 250° C. to 380° C., from 250° C. to 370° C., from 260° C. to 500° C., from 260° C. to 450° C., from 260° C. to 425° C., from 260° C. to 400° C., from 260° C. to 380° C., from 260° C. to 370° C., from 300° C. to 500° C., from 300° C. to 450° C., from 300° C. to 425° C., from 300° C. to 400° C., from 300° C. to 380° C., from 300° C. to 370° C., from 325° C. to 500° C., from 325° C. to 450° C., from 325° C. to 425° C., from 325° C. to 400° C., from 325° C. to 380° C., from 325° C. to 370° C., from 350° C. to 500° C., from 350° C. to 450° C., from 350° C. to 425° C., from 350° C. to 400° C., from 350° C. to 380° C., from 350° C. to 370° C., or approximately 367° C. The hydrocarbon-based composition 105 may have a $T_{90}$ TBP of less than or equal to 750° C., less than or equal to 700° C., or less than or equal to 650° C. In embodiments, the hydrocarbon-based composition 105 may have a $T_{90}$ TBP from 500° C. to 750° C., from 500° C. to 700° C., from 500° C. to 675° C., from 500° C. to 650° C., from 540° C. to 750° C., from 540° C. to 700° C., from 540° C. to 675° C., from 540° C. to 650° C., from 600° C. to 750° C., from 600° C. to 700° C., from 600° C. to 675° C., from 600° C. to 650° C., from 625° C. to 750° C., from 625° C. to 700° C., from 625° C. to 675° C., from 625° C. to 650° C., where the $T_{90}$ TBP is greater than the $T_5$ TBP previously described. The hydrocarbon-based composition 105 may have an API gravity from 5° to 23°, from 5° to 20°, from 5° to 19°, from 5° to 15°, from 5° to 12°, from 8° to 23°, from 8° to 20°, from 8° to 19°, from 8° to 15°, from 8° to 12°, from 10° to 23°, from 10° to 20°, from 10° to 19°, from 10° to 15°, from 10° to 12°, or approximately 11°. The hydrocarbon-based composition 105 may include greater than 2.7 weight percent (wt. %) or greater than 1.7 wt. % total sulfur content by weight of the hydrocarbon-based composition 105. In embodiments, the hydrocarbon-based composition 105 may include from 0.1 wt. % to 5 wt. %, from 0.1 wt. % to 4 wt. %, from 0.1 wt. % to 3.5 wt. %, from 0.5 wt. % to 5 wt. %, from 0.5 wt. % to 4 wt. %, from 0.5 wt. % to 3.5 wt. %, from 1.0 wt. % to 5 wt. %, from 1.0 wt. % to 4 wt. %, from 1.0 wt. % to 3.5 wt. %, from 1.3 wt. % to 5 wt. %, from 1.3 wt. % to 4 wt. %, from 1.3 wt. % to 3.5 wt. %, from 1.6 wt. % to 5 wt. %, from 1.6 wt. % to 4 wt. %, from 1.6 wt. % to 3.5 wt. %, from 1.8 wt. % to 5 wt. %, from 1.8 wt. % to 4 wt. %, from 1.8 wt. % to 3.5 wt. %, from 2.0 wt. % to 5 wt. %, from 2.0 wt. % to 4 wt. %, from 2.0 wt. % to 3.5 wt. %, from 2.3 wt. % to 5 wt. %, from 2.3 wt. % to 4 wt. %, from 2.3 wt. % to 3.5 wt. %, from 2.6 wt. % to 5 wt. %, from 2.6 wt. % to 4 wt. %, from 2.6 wt. % to 3.5 wt. %, from 2.8 wt. % to 5 wt. %, from 2.8 wt. % to 4 wt. %, from 2.8 wt. % to 3.5 wt. %, from 3.0 wt. % to 5 wt. %, from 3.0 wt. % to 4 wt. %, from 3.0 wt. % to 3.5 wt. %, or approximately 3.4 wt. % wt. % total sulfur content by weight of the hydrocarbon-based composition 105. The hydrocarbon-based composition 105 may include greater than 0.9 wt. % or greater than 0.3 wt. % wt. % total nitrogen content by weight of the hydrocarbon-based composition 105. In embodiments, the hydrocarbon-based composition 105 may include from 0.01 wt. % to 2 wt. %, from 0.01 wt. % to 1.3 wt. %, from 0.1 wt. % to 2 wt. %, from 0.1 wt. % to 1.3 wt. %, from 0.2 wt. % to 2 wt. %, from 0.2 wt. % to 1.3 wt. %, from 0.4 wt. % to 2 wt. %, from 0.4 wt. % to 1.3 wt. %, from 0.6 wt. % to 2 wt. %, from 0.6 wt. % to 1.3 wt. %, from 0.8 wt. % to 2 wt. %, from 0.8 wt. % to 1.3 wt. %, from 1.0 wt. % to 2 wt. %, from 1.0 wt. % to 1.3 wt. %, or approximately 1.2 wt. % wt. % total nitrogen content by weight of the hydrocarbon-based composition 105. The hydrocarbon-based composition 105 may include greater than 1.7 wt. % or greater than 0.3 wt. % asphaltene (heptane-insoluble) by weight of the hydrocarbon-based composition 105. In embodiments, the hydrocarbon-based composition 105 may include from 0.01 wt. % to 6 wt. %, from 0.01 wt. % to 5 wt. %, from 0.01 wt. % to 4.9 wt. %, from 0.1 wt. % to 6 wt. %, from 0.1 wt. % to 5 wt. %, from 0.1 wt. % to 4.9 wt. %, from 0.2 wt. % to 6 wt. %, from 0.2 wt. % to 5 wt. %, from 0.2 wt. % to 4.9 wt. %, from 0.4 wt. % to 6 wt. %, from 0.4 wt. % to 5 wt. %, from 0.4 wt. % to 4.9 wt. %, from 0.6 wt. % to 6 wt. %, from 0.6 wt. % to 5 wt. %, from 0.6 wt. % to 4.9 wt. %, from 0.8 wt. % to 6 wt. %, from 0.8 wt. % to 5 wt. %, from 0.8 wt. % to 4.9 wt. %, from 1.0 wt. % to 6 wt. %, from 1.0 wt. % to 5 wt. %, from 1.0 wt. % to 4.9 wt. %, from 1.6 wt. % to 6 wt. %, from 1.6 wt. % to 5 wt. %, from 1.6 wt. % to 4.9 wt. %, from 1.8 wt. % to 6 wt. %, from 1.8 wt. % to 5 wt. %, from 1.8 wt. % to 4.9 wt. %, from 2.0 wt. % to 6 wt. %, from 2.0 wt. % to 5 wt. %, from 2.0 wt. % to 4.9 wt. %, from 2.5 wt. % to 6 wt. %, from 2.5 wt. % to 5 wt. %, from 2.5 wt. % to 4.9 wt. %, from 3.0 wt. % to 6 wt. %, from 3.0 wt. % to 5 wt. %, from 3.0 wt. % to 4.9 wt. %, from 4.7 wt. % to 6 wt. %, from 4.7 wt. % to 5 wt. %, from 4.7 wt. % to 4.9 wt. %, or approximately 4.8 wt. % asphaltene (heptane-insoluble) by weight of the hydrocarbon-based composition 105. The hydrocarbon-based composition 105 may include greater than 9 parts per million (ppm) or greater than 4 ppm metals. In embodiments, the metals may be vanadium, nickel, or both. In embodiments, the hydrocarbon-based composition may include from 1 ppm to 100 ppm, from 1 ppm to 83 ppm, from 5 ppm to 100 ppm, from 5 ppm to 83 ppm, from 10 ppm to 100 ppm, from 10 ppm to 83 ppm, from 50 ppm to 100 ppm, from 50 ppm to 83 ppm, or approximately 82 ppm metals. The hydrocarbon-based composition 105 may have a viscosity at 50° C. of greater than 27 centiStokes (cSt) or greater than 89 cSt. In embodiments, the hydrocarbon-based composition 105 may have a viscosity at 50° C. from 5 cSt to 1000 cSt, from 5 cSt to 700 cSt, from 5 cSt to 650 cSt, from 10 cSt to 1000 cSt, from 10 cSt to 700 cSt, from 10 cSt to 650 cSt, from 100 cSt to 1000 cSt, from 100 cSt to 700 cSt, from 100 cSt to 650 cSt, from 300 cSt to 1000 cSt, from 300 cSt to 700 cSt, from 300 cSt to 650 cSt, from 500 cSt to 1000 cSt, from 500 cSt to 700 cSt, from 500 cSt to 650 cSt, or approximately 640 cSt.

As shown in FIG. 1, the hydrocarbon-based composition 105 may be pressurized in hydrocarbon pump 112 to create pressurized hydrocarbon-based composition 116. The pressure of pressurized hydrocarbon-based composition 116 may be at least 22.1 megapascals (MPa), which is approximately the critical pressure of water. Alternatively, the pressure of the pressurized hydrocarbon-based composition 116 may be between 23 MPa and 35 MPa, or between 24 MPa and 30 MPa. For instance, the pressure of the pressurized hydrocarbon-based composition 116 may be between 25 MPa and 29 MPa, 26 MPa and 28 MPa, 25 MPa and 30 MPa, 26 MPa and 29 MPa, or 24 MPa and 28 MPa.

The pressurized hydrocarbon-based composition 116 may then be heated in one or more hydrocarbon pre-heaters 120 to form pressurized, heated hydrocarbon-based composition 124. In one embodiment, the pressurized, heated hydrocarbon-based composition 124 has a pressure greater than the critical pressure of water and a temperature greater than 75° C. Alternatively, the temperature of the pressurized, heated hydrocarbon-based composition 124 is between 10° C. and 300° C., or between 50° C. and 250° C., or between 75° C. and 225° C., or between 100° C. and 200° C., or between 125° C. and 175° C., or between 140° C. and 160° C. According to embodiments, the pressurized, heated hydrocarbon-based composition 124 should not be heated above about 350° C., and in some embodiments, the pressurized, heated hydrocarbon-based composition should not be heated above 300° C. to avoid the formation of coking products. See Hozuma, U.S. Pat. No. 4,243,633, which is incorporated by reference in its entirety. While some coke or coke precursor products may be able to pass through process lines without slowing or stopping the process 100, the formation of these potentially problematic compounds should be avoided if possible.

Embodiments of the hydrocarbon pre-heater 120 may include a natural gas fired heater, heat exchanger, or an electric heater or any type of heater known in the art. In some embodiments, not shown, the pressurized, heated hydrocarbon-based composition 124 may be heated in a double pipe heat exchanger. For example, and not by way of limitation, the double pipe heat exchanger may heat the pressurized, heated hydrocarbon-based composition 124 after it has combined with a heated water stream 126 and/or a heated hydrogen stream 129 to form a combined feed stream 132.

The water stream 110 may be any source of water, such as a water stream having conductivity of less than 1 microSiemens (μS)/centimeters (cm), such as less than 0.1 μS/cm. The water stream 110 may also include demineralized water, distilled water, boiler feed water (BFW), and deionized water. In at least one embodiment, water stream 110 is a boiler feed water stream. Water stream 110 is pressurized by water pump 114 to produce pressurized water stream 118. The pressure of the pressurized water stream 118 is at least 22.1 MPa, which is approximately the critical pressure of water. Alternatively, the pressure of the pressurized water stream 118 may be between 23 MPa and 35 MPa, or between 24 MPa and 30 MPa. For instance, the pressure of the pressurized water stream 118 may be between 25 MPa and 29 MPa, 26 MPa and 28 MPa, 25 MPa and 30 MPa, 26 MPa and 29 MPa, or 24 MPa and 28 MPa.

The pressurized water streams 118, 218, and 318 may then be heated in a water pre-heater 122 to create heated water stream 126. According to embodiments, the temperature of the heated water stream 126 is greater than 100° C. In embodiments, the temperature of the heated water stream 126 may be from 100° C. to 370° C., from 100° C. to 350° C., from 100° C. to 300° C., from 100° C. to 250° C., from 100° C. to 200° C., from 100° C. to 150° C., from 150° C. to 370° C., from 150° C. to 350° C., from 150° C. to 300° C., from 150° C. to 250° C., from 150° C. to 200° C., from 200° C. to 370° C., from 200° C. to 350° C., from 200° C. to 300° C., from 200° C. to 250° C., from 250° C. to 370° C., from 250° C. to 350° C., from 250° C. to 300° C., from 300° C. to 370° C., from 300° C. to 350° C., or from 350° C. to 370° C.

Similar to hydrocarbon pre-heater 120, suitable water pre-heaters 122 may include a natural gas fired heater, a heat exchanger, and an electric heater. The water pre-heater 122 may be a unit separate and independent from the hydrocarbon pre-heater 120.

The hydrogen stream 127 may be any source of hydrogen. The hydrogen stream 127 may be heated in a hydrogen pre-heater 128 to create heated hydrogen stream 129. According to embodiments, the temperature of the heated hydrogen stream 129 is greater than 100° C. In embodiments, the temperature of the heated hydrogen stream 129 may be from 100° C. to 370° C., from 100° C. to 350° C., from 100° C. to 300° C., from 100° C. to 250° C., from 100° C. to 200° C., from 100° C. to 150° C., from 150° C. to 370° C., from 150° C. to 350° C., from 150° C. to 300° C., from 150° C. to 250° C., from 150° C. to 200° C., from 200° C. to 370° C., from 200° C. to 350° C., from 200° C. to 300° C., from 200° C. to 250° C., from 250° C. to 370° C., from 250° C. to 350° C., from 250° C. to 300° C., from 300° C. to 370° C., from 300° C. to 350° C., or from 350° C. to 370° C.

Similar to hydrocarbon pre-heater 120 and water pre-heater 122, suitable hydrogen pre-heaters 128 may include a natural gas fired heater, a heat exchanger, and an electric heater. The hydrogen pre-heater 128 may be a unit separate and independent from the hydrocarbon pre-heater 120 and the water pre-heater 122.

The heated water stream 126, the heated hydrogen stream 129, and the pressurized, heated hydrocarbon-based composition 124 may then be mixed in a feed mixer 130 to produce a combined feed stream 132. The feed mixer 130 can be any type of mixing device capable of mixing the heated water stream 126 and the pressurized, heated hydrocarbon-based composition 124. In one embodiment, the feed mixer 130 may be a mixing tee. The feed mixer 130 may be an ultrasonic device, a small continuous stir tank reactor (CSTR), or any suitable mixer. The volumetric flow ratio of each component fed to the feed mixer 130 may vary. It should also be understood that in one or more embodiments, which are not shown, multiple feed mixers may be used to individually mix the pressurized, heated hydrocarbon-based composition 124, the heated hydrogen stream 129, and the heated water stream 126 in any combination. In embodiments, the volumetric flow ratio of the heated hydrocarbon-based composition 124 to the heated water stream 126 may be from 1:10 to 1:1, from 1:10 to 1:5, from 1:10 to 1:2, from 1:5 to 1:1, from 1:5 to 1:2, or from 1:2 to 1:1 at standard ambient temperature and ambient pressure (SATP). In embodiments it is desirable that the volumetric flow rate of water is greater than the volumetric flow rate of hydrocarbons. Without being bound by any particular theory, it is believed that heavy oils such as residual and bituminous types are rich in fractions that contain asphaltenes and heavy polycondensed aromatic molecules. These fractions yield a high viscosity. Mixing hot compressed water, such as supercritical water, reduces the viscosity and improves the oil's mobility through the developed mixed oil/water phase. Therefore, having a water flow rate that is higher than an oil flow rate improves the mixture mobility especially for highly viscous oils. Furthermore, increasing the water-to-oil ratio improves the caging effect of water molecules surrounding the asphaltenic and polycondensed aromatic molecules and increases the distance between them to prevent their propagation and association. In embodiments, the hydrogen-to-oil volumetric flow can be from 10 to 5000 cubic feet of heated hydrogen stream 129 to one barrel of heated hydrocarbon-based composition 124, at SATP.

The combined feed stream 132 may then be introduced to the supercritical water hydrogenation reactor 150 that is configured to upgrade the combined feed stream 132. The supercritical water hydrogenation reactor 150 may be an upflow, downflow, or horizontal flow reactor. An upflow, downflow or horizontal reactor refers to the direction the supercritical water and hydrocarbon-based composition flow through the supercritical water hydrogenation reactor 150. An upflow, downflow, or horizontal flow reactor may be chosen based on the desired application and system configuration. Without intending to be bound by any theory, in downflow supercritical reactors, heavy hydrocarbon fractions may flow very quickly due to having a greater density, which may result in shortened residence times (known as channeling). This may hinder upgrading, as there is less time for reactions to occur. Upflow supercritical reactors have a uniform increased residence time distribution (no channeling), but may experience difficulties due to undissolved portion of heavy fraction and large particles, such as carbon-containing compounds in the heavy fractions, accumulating in the bottom of the reactor. This accumulation may hinder the upgrading process and plug the reactor. Upflow reactors typically utilize catalysts to provide increased contact with the reactants; however, the catalysts may break down due to the harsh conditions of supercritical water, forming insoluble aggregates, which may generate coke. Horizontal reactors may be useful in applications that desire phase separation or that seek to reduce pressure drop, however; the control of hydrodynamics of internal fluid is difficult. Each type of reactor flow has positive and negative attributes that vary based on the applicable process; however, in some embodiments, an upflow or downflow reactor may be favored.

The supercritical water hydrogenation reactor 150 may operate at a temperature greater than the critical temperature of water and a pressure greater than the critical pressure of water. In one or more embodiments, the supercritical water hydrogenation reactor 150 may have a temperature of between 380° C. to 480° C., or between 390° C. to 450° C. The supercritical water hydrogenation reactor 150 may be an isothermal or non-isothermal reactor. The reactor may be a tubular-type vertical reactor, a tubular-type horizontal reactor, a vessel-type reactor, a tank-type reactor having an internal mixing device, such as an agitator, or a combination of any of these reactors. Moreover, additional components, such as a stirring rod or agitation device may also be included in the supercritical water hydrogenation reactor 150.

The supercritical water hydrogenation reactor 150 may have dimensions defined by the equation L/D, where L is a length of the supercritical water hydrogenation reactor 150 and D is the diameter of the supercritical water hydrogenation reactor 150. In one or more embodiments, the L/D value of the supercritical water hydrogenation reactor 150 may be sufficient to achieve a superficial velocity of fluid greater than 0.5 meter (m)/minute (min), or an L/D value sufficient to achieve a superficial velocity of fluid between 1 m/min and 5 m/min. Such relatively high fluid velocity is desired to attain full turbulence of the internal fluid. The desired Reynolds number (a measurement of fluid flow) is greater than 5000. Reynolds number is given by the relationship:

$$Re = \frac{uD}{\nu}$$

where u is the superficial velocity, D is the diameter of the supercritical upgrading reactor, and v is the kinematic viscosity. If that equation is rewritten as $$u = \frac{vRe}{D}$$

it can be observed from this relationship that by decreasing the reactor diameter (D) the superficial velocity (u) is increased (because u and D are indirectly proportional to each other ( $$\left(u\alpha\frac{1}{D}\right)).$$

For a fixed reactor length at a reference case, decreasing the reactor diameter (D) will increase the ratio (L/D). Furthermore, by increasing the superficial velocity (u), Reynolds Number (Re) is increased (because u and Re are directly proportional to each other (u α Re). Therefore, from the above rationale, in order to maintain the flow in high flow turbulence regime (Re>5000), it is required to increase the superficial velocity, and/or decrease the reactor's diameter, and by decreasing the reactor's diameter, the ratio (L/D) is also increased.

In some embodiments, the residence time of the internal fluid in the supercritical water hydrogenation reactor 150 may be longer than 5 seconds, such as longer than 1 minute. In some embodiments, the residence time of the internal fluid in the supercritical water hydrogenation reactor 150 may be from 1 to 30 minutes, from 1 to 20 minutes, from 1 to 15 minutes, from 1 to 12 minutes, from 1 to 10 minutes, from 1 to 8 minutes, from 1 to 5 minutes, from 1 to 2 minutes, from 2 to 30 minutes, from 2 to 20 minutes, from 2 to 15 minutes, from 2 to 12 minutes, from 2 to 10 minutes, from 2 to 8 minutes, from 2 to 5 minutes, from 5 to 30 minutes, from 5 to 20 minutes, from 5 to 15 minutes, from 5 to 12 minutes, from 5 to 10 minutes, from 5 to 8 minutes, from 8 to 30 minutes, from 8 to 20 minutes, from 8 to 15 minutes, from 8 to 12 minutes, from 8 to 10 minutes, from 10 to 30 minutes, from 10 to 20 minutes, from 10 to 15 minutes, from 10 to 12 minutes, from 12 to 30 minutes, from 12 to 20 minutes, from 12 to 15 minutes, from 15 to 30 minutes, from 15 to 20 minutes, or from 20 to 30 minutes. In embodiments, the residence time may be no greater than 15 minutes and no less than 2 minutes.

The supercritical water upgrading process is aided by the addition of the heated hydrogen stream 129 to convert a greater amount of heavy hydrocarbons into lighter hydrocarbons. The supercritical water upgrading process and the addition of the heated hydrogen stream have a synergistic effect because the supercritical water dissolves the oil; maximizes mixing of the combined feed stream 130 (oil, water, and hydrogen components); ruptures hydrocarbon and heteroatom chemical bonds; cages asphaltenes and large hydrocarbon radicals (preventing their polymerization); and provides high pressure that brings hydrogen to hydrocarbon and heteroatom radicals' moieties to further rupture chemical bonds and saturate the free hydrocarbon and heteroatom radicals; and the hydrogen addition facilitates rupturing hydrocarbon and heteroatom chemical bonds and saturates the free hydrocarbon and heteroatom radicals generated by the combined effect of supercritical water and the added hydrogen. Specifically, the hydrogen addition may suppress gummy olefin, asphaltene, and coke generation; increase the conversion of the heavy fraction (hydrocarbons having a $T_5$ of greater than 540° C. and/or an API gravity of less than 17°) in the combined feed stream 130 to lighter fractions; allow for increasing operating severity by either increasing temperature or reducing flow rate, thereby increasing the heavy fraction conversion; and provide hydrotreating to the combined feed stream 130 by converting heteroatoms such as sulfur to $H_2S$.

Thermal processes are temperature driven chemical processes that convert and upgrade petroleum heavy hydrocarbons via radical mechanism. The typical thermal cracking processes temperature range is between 495 and 540° C. and typical pressure is in the range of 10 and 40 atmospheres. The severities of thermal processes determine the extent of feed conversion. Process severity refers to the levels of operating conditions in terms of combinations of temperature and space times. Thermal processes utilize heat to crack heavy hydrocarbons into lighter end products, thereby reducing the oil viscosity without catalyst addition. However, the presence of asphaltenes in the heavy hydrocarbons limits upgradability. The amount of asphaltene in the hydrocarbon stream is directly related to its affinity to form coke, due to asphaltene condensation reactions. See Yan, T. Y., *Characterization of visbreaker feeds*. Fuel, 1990. 69(8): p. 1062-1064. The reactions taking place in thermal processes are a combination of endothermic reactions that proceed according to free radical mechanisms. The chemistry of thermal cracking is rather complex, and the degree of complexity increases with the increase in process severity for heavier feedstocks. Through thermal cracking, chemical bonds of different species present in the oil are subjected to endothermic homolytic dissociation reactions. During this bond cleavage procedure, the asphaltene solvating appendages are detached and the aliphatic bridges, connecting the polyaromatic clusters within the asphaltene molecules, are broken. This makes the asphaltene aggregates prone to precipitation in a less peptizing environment. In addition, dehydrogenation reactions of asphaltene aggregates result in increasing C/H ratios, which increase the molecular weight of the asphaltene molecules. Thermal processes proceed by initiation reactions where a portion of feed hydrocarbon molecules (M) break into multiple hydrocarbon radicals (R.), by homolytic cleavage of the C—C bonds. As a result, free radicals are accumulated until reaching a steady-stable concentration that allows the thermal cracking propagation reactions to continue. The generated free radicals shown by Equation 1 below drive the rest of the reactions.

$$M \rightarrow R. + R_n. \quad (1)$$

The above reaction step is followed by a chain of reactions, which includes hydrogen abstraction and addition, and radical cracking and recombination. The produced free radicals abstract hydrogen from nearby molecules, as shown by Equation 2.

$$R. + M \rightarrow R_1. + RH \quad (2)$$

Generated radicals are also dealkylated, simultaneously, to produce smaller alkane radicals, as shown by Equation 3.

$$R_1 \rightarrow R_2. + R_3. \quad (3)$$

where, $R_1 > R_2 > R_3$, meaning that the $R_1$ radical is larger than the $R_2$ radical, which is larger than the $R_3$ radical.

Under constant flow, reactions 1-3 continue to take place unless interrupted by major change in feedstock properties or operating conditions. If the temperature or space time increases beyond the stability limit, heavy free radical combination reactions escalate to produce larger and heavier molecules. These combination reactions terminate the reaction mechanism and cause asphaltene condensation, hence called condensation reactions, as shown by Equation 4.

$$R.+R.\rightarrow M \quad (4)$$

The combinations resulting from termination reactions may produce heavier compounds than the ones present originally in the feedstock. The cleavage of C—C bond in alkanes requires lower energy than the cleavage of C—H and H—H bonds. For example while the cleavage of the C—C bond in ethane ($CH_3$—$CH_3$) requires dissociation energy of 360 KJ/mole, the cleavage of the C—H bond ($C_2H_5$—H) requires dissociation energy of 410 KJ/mole, as shown Table 1. The same observation is noticed for the bond energy of H-Aromatics, which is higher than the bond energy of C-Aromatics. The data in Table 1 are given at standard ambient temperature and ambient pressure (SATP) (see Raseev, S., Thermal and catalytic processes in petroleum refining, page 37, 2003: CRC Press, 1st ed.)

TABLE 1

Chemical Bond Dissociation Energies for Different Hydrocarbons.

| Bond | Dissociation Energy (kJ/mole) |
|---|---|
| H—H | 435 |
| $CH_2$—H | 356 |
| $CH_3$—H | 431 |
| $C_2H_5$—H | 410 |
| n-$C_3H_7$—H | 398 |
| i-$C_3H_7$—H | 394 |
| n-$C_4H_9$—H | 394 |
| i-$C_4H_9$—H | 390 |
| $CH_3$—$CH_3$ | 360 |
| $C_2H_5$—$CH_3$ | 348 |
| n-$C_4H_9$—$C_2H_5$ | 322 |
| $C_6H_5$—$C_6H_5$ | 415 |
| $(C_6H_5)_3C$—$C(C_6H_5)_3$ | 46 |
| 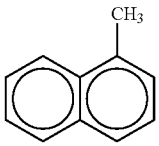 | 364 |
| 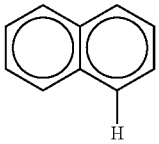 | 423 |

It is also observed from Table 1 that the dissociation energy of the C—H bond in alkanes tends to decrease as the alkane molecular size increases. This indicates that lower molecular weight hydrocarbon species are kinetically more stable than heavier ones.

The dissociation energies at different temperatures, such as at supercritical temperatures, may be calculated from thermodynamics starting from the tabulated dissociation enthalpies at 298K. For example, to estimate the oxygen-hydrogen bond (O—H) dissociation enthalpy starting from 298K at a fixed pressure, the following expression estimates the bond dissociation enthalpy at a supercritical temperature of 450° C. (723K): $\Delta H_{(723K)}=\Delta H_{(298K)}+\Delta C_p \Delta T$. After finding the heat capacities ($\Delta C_P$) from thermodynamic data references such as Brunner, G., *Hydrothermal and supercritical water processes*. Vol. 5. 2014: Elsevier, at the required temperature, the bond dissociation enthalpy at 723K is estimated to be 442 KJ/mol.

Non-carbon rejection processes, at relatively higher operating cost such as hydrocracking, upgrade oil to produce stable products distant from, gummy olefin generation, asphaltene precipitation, and/or coke formation reactions. These products are believed to retain sufficient H/C ratios to preserve their stability. Hydrogen based routes include hydrocracking (a hydrogenolysis process), operated at around 200 bars and 350 to 400° C., allows refiner to produce hydrocarbons having a lower molecular weight with higher H/C ratios and a lower yield of coke. The mechanism of hydrogenolysis is basically similar to that of thermal cracking, but the cracking is promoted by high hydrogen partial and catalyst with concurrent hydrogenation. Hydrotreating is a mild hydrogen based process that operates at 30 to 130 bars and 300 to 400° C., allows reducing impurities from the oil like sulfur and metals without major cracking to the oil. Overall, olefins and coke formation is very low in hydrogenous processes since the large hydrocarbon radicals' combination reactions and the formation of coke precursors are suppressed as the hydrogen pressure is increased. Oil upgrading and quality improvements by hydrogenous processes have been vastly practiced in industry to generate light products (hydrocracking) and/or to remove impurities (hydrotreating). Hydrogen-based upgrading processes typically utilize bi-metallic catalysts and hydrogen at different pressures, which result in high operating costs due to high hydrogen partial pressure requirement and catalyst and related regeneration Testing and Inspection (T&I) costs. Furthermore, hydrocracking is a catalytic process that necessitates treating the feedstock ahead of the process to prevent catalyst poisoning. Therefore, hydrocracker feed is usually treated by catalytic hydrotreating at lower pressures to remove sulfur, nitrogen, metals, and other catalyst poisoning materials. This hydrotreating step adds to the cost of the catalytic hydrocracking process. In addition to hydrogen consumption of 1200 to 2400 standard cubic foot per oil barrel (SCFB), hydrocracking process conventionally requires high hydrogen partial pressure of around 200 bars to facilitate cracking the hydrocarbon molecules.

Water above its critical condition (about 374° C. and about 221 bar), termed supercritical water, is neither a liquid nor gas but a single fluid phase that converts from being polar to non-polar. Supercritical water can diffuse through semi-solid materials that are insusceptible to penetration otherwise at lower conditions, such as polynuclear aromatics and asphaltenes. Supercritical water completely dissolves hydrocarbon oils, and therefore, both phases become totally miscible. The distinctive characteristics of water in supercritical state improve liquid yield and properties of cracking, desulfurization, and demetallization reactions. Hydrocarbon oil cracking via supercritical water proceeds by a similar free radical mechanism as that of thermal cracking, and is highly selective towards breaking of heavy fractions to produce middle distillate oils without coke generation. Furthermore, during upgrading, supercritical water molecules isolate and separate the most heavy oil fraction molecules by the caging effect, which extends the upgrading reaction at the expense of condensation reactions. NMR analysis has revealed that the asphaltene content of supercritical water treated oil decreased to a large extent, while saturate, olefin, and aromatic content increased. When supercritical water is mixed with oil it dissolves all the oil constituents, including asphaltene. The dissolution takes place by swelling and breaching the asphaltene aggregates, thereby reducing the asphaltene aggregate particles size from about 1 to 800 microns to much smaller molecules having a particle size of from 0.1 to 300 nanometers (nm) that are distributed throughout the water/oil mixture. These relatively smaller asphaltene molecules are caged by water molecules surrounding them, which prevent them from association, aggregation, and deposition during the upgrading reactions.

As stated above, processes using supercritical water can generate olefins and polycondensed aromatics, which can lead to gumming. As stated previously, the high temperature of the supercritical water reactor induces thermal cracking of chemical bonds that may be filled with hydrogen to avoid intermolecular condensation and generation of olefins and polycondensed aromatics. Although the hydrogen inherently present in the water molecules can participate in the cracking reaction, the extent of hydrogen donation from water is quite limited in supercritical water conditions due to high hydrogen-oxygen bond energy. The hydrogen-oxygen dissociation energy at supercritical conditions can be calculated as provided above. Thus, the upgraded product from a supercritical water process has a greater aromaticity and olefinicity than the hydrocarbon feed, which has a negative effect on the stability of the products.

Supercritical water prevents the asphaltenes and heavy molecules from association and precipitation by breaking the large molecules into smaller ones and by caging the polycondensed aromatic clusters (asphaltenes) molecules and breaking bridging bonds (such as carbon-sulfur-carbon) between large polyaromatic compounds and keeping them apart. Moreover, the supercritical water fully dissolves and converts the kinetically active hydrocarbon species such as large molecules. The upgrading reaction mechanism involves hydrocarbon and hydrogen abstraction reactions, which generates numerous free radicals. Appreciable portion of these generated radicals are subjected to cracking reactions, reforming reactions, combination reactions, addition reactions, substitution reactions, and others. The overall result of these reactions is the generation of new improved quality product fractions that improves the overall supercritical water product quality including API and asphaltenes reduction. However, after departing from the water supercritical conditions, and after cooling and pressure let down, some of the molecules and light hydrocarbon radicals that require longer time to complete their conversion reactions tend to associate and/or form double bonds to fulfill their unpaired electrons in the absence of hydrogen. These species are generated by hydrogen and light hydrocarbon abstraction reactions, which increase their C/H ratios. This increase is translated by increase in aromaticity, which is the conversion of cyclic hydrocarbons (having no double bonds or a single double bond) and to some extent straight chain hydrocarbons into aromatics, and by cleavage of alkyl appendages that are cross linking different smaller aromatics. Once their alkyl appendages are cleaved, the different smaller aromatic radicals combines into larger aromatic clusters, which also increases the oil aromaticity. Similarly, hydrogen abstraction reactions in a supercritical water process generates radicals, which tend to form double bond species (olefins) in the absence of hydrogen. Availing enough hydrogen during upgrading saturates these molecules that then require increased time for conversion into valuable products, which minimizes their interaction and limits their double bond formation. This issue may be addressed by using a catalyst in the supercritical water process, but no catalysts have been used in a supercritical water process due to the harsh conditions of supercritical water that makes most catalysts unstable in the presence of supercritical water. The disintegration of heterogeneous catalysts is frequently observed in the presence of supercritical water. Additionally, homogeneous catalysts, such as organometallic compounds, can be transformed to an inactive form under supercritical water conditions. Conventionally, this problem has been addressed by adding catalysts to be used in a separate process downstream from the supercritical water process as a post treatment option. However, using a downstream process requires major capital investment for dedicated infrastructure, such as reactor(s), pumps and compressor, and cooler(s) and heat exchanger(s) in addition to catalyst catalysts with its costs of purchasing, replacement, and regenerating due to deactivation.

Consequently, the processes described in this disclosure do not use a catalyst. Supercritical water processes hydrothermally crack the hydrocarbon molecules under high operating pressures, as previously described, which are greater than conventional hydrocracking pressures. Under this high pressure range, hydrogenation can suppress gummy olefin generation, heavy hydrocarbon radical polymerization, and condensation reactions that lead to coke formation in thermal cracking. The supercritical water process high pressure can be exploited by adding a low amount of hydrogen to the supercritical water at hydrogen partial pressure of 1-30 bar, more specifically at 2-6 bar (based on oil type). The hydrogen partial pressure may be dependent on the hydrocarbons present. For example, highly viscous oils such as residual and bituminous oils require relatively greater amounts of hydrogen because they are highly deficient in hydrogen content (very high C/H ratio) because they contain an abundance of heavy hydrocarbon molecules. In order to generate lighter hydrocarbon fractions out of these heavy oils, their generated free radicals must be saturated with abundant hydrogen. In addition to forming double bond species, the generated free radicals, especially the heavy ones, in the absence of hydrogen, tend to associate and form bigger and heavier molecules and aggregates that are prone to precipitation. The hydrogen-to-oil volumetric flow may be between (10 to 5000 $ft^3$) $H_2$ to one barrel of oil, at standard ambient temperature and ambient pressure (SATP).

In addition to rupturing different types of bonds in the oil, supercritical water facilitates hydrogen availability in the vicinities of the cracked hydrocarbon and heteroatoms moieties, through hydrogen, water, and oil mixing in high pressure environments. Therefore, in addition to hydrothermally generated free hydrocarbon and heteroatoms radicals by supercritical water, the added hydrogen facilitates further cracking of hydrocarbon and heteroatoms molecule into free radicals and saturates the overall generated radicals including heteroatoms (for example converts S to $H_2S$), simultaneously, under the supercritical water process conditions. The disclosed process combines carbon rejection and non-carbon rejection processes in a single process that combines the benefits of operating at lower cost than conventional hydrocracking processes to produce more stable products than thermal cracking. In this disclosure, the non-catalytically produced free large hydrocarbon radicals by the combined effect of supercritical water hydrothermal and hydrogenolysis are saturated and prevented from combination reactions that terminate the upgrading reaction mechanism and lead to gummy olefin, asphaltene, and coke formations. Furthermore, the presence of hydrogen in the supercritical water hydrogenation process will treat the oil by saturating the generated free heteroatoms radicals, such as converting sulfur to $H_2S$.

Hydrogenolysis processes such as hydrocracking require high hydrogen partial pressure and catalysts to rupture the carbon-sulfur and carbon-carbon, and carbon-metal bonds. In the present disclosure, the supercritical water hydrogenation reactions rupture hydrocarbon and heteroatom bonds and provide the required high pressure for hydrogenation reactions at low hydrogen partial pressure. It is contemplated that low hydrogen partial pressure is desirable because it eliminates the need for dedicated gas compressors and thereby reduces maintenance and utilities costs. Additionally, in embodiments, low hydrogen partial pressure eliminates high hydrogen consumption that is needed to maintain high hydrogen partial pressure. Under the supercritical water hydrogenation process conditions, the relatively lower molecular weight hydrocarbon species of $C_1$ to $C_7$ hydrocarbons (paraffins, cycloparaffins, and aromatics) are kinetically more stable than the heavier ones. Therefore, supercritical water hydrogenation process is highly selective towards breaking of heavy fractions to produce middle distillate oils without gummy olefin, asphaltene, and coke generation. Furthermore, during upgrading, supercritical water molecules isolate and separate the most heavy oil fraction molecules by the caging effect, which extends the upgrading reaction at the expense of condensation reactions, thereby decreasing condensation reactions.

Hydrogen addition into the supercritical water process provides additional yields of middle distillate oils but at improved stability by saturating heavy hydrocarbon radicals and olefins that has potential to generate gums. In addition, the supercritical water process breaks large asphaltene aggregates of size 1 to 800 microns to much smaller scattered radical aggregates of size 0.1 to 300 nm that can readily be approached and saturated by hydrogen due to its small size (1.06-1.20 angstrom). This in turn reduces the asphaltene content in the oil by converting them into lighter fractions. Therefore, supercritical water facilitates the hydrogenation of heavy hydrocarbon radicals including olefin and asphaltene radicals and prevents their combination reactions that terminate the upgrading reaction mechanism. In other words, the hydrogen addition to the supercritical water process passivates the combination reactions of large hydrocarbon radicals and olefins that are hydrothermally generated by supercritical water, thereby preventing gum, asphaltene, and coke generation, which allows for increasing process severity for additional oil upgrading.

Large hydrocarbon molecules cracking and radicals' saturation reactions in supercritical water hydrogenation are favored by high operating pressure; therefore, increasing process severity in terms of higher pressures will facilitate large hydrocarbon and heteroatom bonds rupturing and hydrogenation of the generated radicals as well as increasing oil conversion. Furthermore, supercritical water processes have been reported to desulfurize and demetalize hydrocarbon oil. Adding hydrogen to the supercritical water process will further enhance the sulfur and metals removal by hydrogenating the heteroatoms (hydrotreating). Therefore, adding hydrogen to the supercritical water process will expand the application of the supercritical water technology for treating sulfur rich streams (such as disulfide oils) besides upgrading by facilitating C—S and S—S bond rupturing and hydrogenating the sulfur radicals in supercritical water to generate hydrogen sulfide and light hydrocarbons, as shown by equation 5.

$$CH_3—S—S—CH_3+2H_2 \rightarrow CH_3—CH_3+2H_2S \quad (5)$$

Therefore, there exists recognizable synergy between supercritical water and added hydrogen to upgrade and improve hydrocarbon oils. It is contemplated that the supercritical water hydrogenation reactor 150 may dissolve the hydrocarbons and hydrogen in supercritical water and break the M-S bonds (having a bond energy of approximately 290 kJ/mol), M-M bonds, H—H bonds, and MS-SM bonds (having a bond energy of approximately 260 kJ/mol), and hydrogenate the generated hydrocarbon and heteroatom radicals. Within the supercritical water hydrogenation reactor 150, it is contemplated that large hydrocarbon molecules (including asphaltene aggregates) are dissolved, broken, dispersed, and hydrogenated in the oil medium, in addition to hydrocarbon upgrading by improving properties such as API gravity and reducing properties such as density, viscosity, and heteroatoms (including metals).

Upon exiting the supercritical water hydrogenation reactor 150, the upgraded product 152 may have a $T_5$ true boiling point (TBP) of less than 500° C., of less than 400° C., of less than 350° C., of less than 325° C., of less than 310° C., or of less than 300° C. In embodiments, the upgraded product 152 may have a $T_5$ TBP of from 25° C. to 350° C., from 25° C. to 325° C., from 25° C. to 300° C., from 25° C. to 275° C., from 25° C. to 250° C., from 25° C. to 225° C., from 25° C. to 200° C., from 25° C. to 175° C., from 25° C. to 150° C., from 25° C. to 125° C., from 25° C. to 100° C., from 25° C. to 75° C., from 25° C. to 50° C., from 50° C. to 350° C., from 50° C. to 325° C., from 50° C. to 300° C., from 50° C. to 275° C., from 50° C. to 250° C., from 50° C. to 225° C., from 50° C. to 200° C., from 50° C. to 175° C., from 50° C. to 150° C., from 50° C. to 125° C., from 50° C. to 100° C., from 50° C. to 75° C., from 75° C. to 350° C., from 75° C. to 325° C., from 75° C. to 300° C., from 75° C. to 275° C., from 75° C. to 250° C., from 75° C. to 225° C., from 75° C. to 200° C., from 75° C. to 175° C., from 75° C. to 150° C., from 75° C. to 125° C., from 75° C. to 100° C., from 100° C. to 350° C., from 100° C. to 325° C., from 100° C. to 300° C., from 100° C. to 275° C., from 100° C. to 250° C., from 100° C. to 225° C., from 100° C. to 200° C., from 100° C. to 175° C., from 100° C. to 150° C., from 100° C. to 125° C., from 125° C. to 350° C., from 125° C. to 325° C., from 125° C. to 300° C., from 125° C. to 275° C., from 125° C. to 250° C., from 125° C. to 225° C., from 125° C. to 200° C., from 125° C. to 175° C., from 125° C. to 150° C., from 150° C. to 350° C., from 150° C. to 325° C., from 150° C. to 300° C., from 150° C. to 275° C., from 150° C. to 250° C., from 150° C. to 225° C., from 150° C. to 200° C., from 150° C. to 175° C., from 175° C. to 350° C., from 175° C. to 325° C., from 175° C. to 300° C., from 175° C. to 275° C., from 175° C. to 250° C., from 175° C. to 225° C., from 175° C. to 200° C., from 200° C. to 350° C., from 200° C. to 325° C., from 200° C. to 300° C., from 200° C. to 275° C., from 200° C. to 250° C., from 200° C. to 225° C., from 225° C. to 350° C., from 225° C. to 325° C., from 225° C. to 300° C., from 225° C. to 275° C., from 225° C. to 250° C., from 250° C. to 350° C., from 250° C. to 325° C., from 250° C. to 300° C., from 250° C. to 275° C., from 275° C. to 350° C., from 275° C. to 325° C., from 275° C. to 300° C., from 300° C. to 350° C., from 300° C. to 325° C., or from 325° C. to 350° C. The upgraded product 152 may have a $T_{90}$ TBP of less than or equal to 650° C., less than or equal to 610° C., or less than or equal to 600° C. In embodiments, upgraded product 152 may have a $T_{90}$ TBP from 200° C. to 650° C., from 200° C. to 600° C., from 200° C. to 575° C., from 200° C. to 550° C., from 200° C. to 540° C., from 200° C. to 530° C., from 200° C. to 525° C., from 200° C. to 500° C., from 200° C. to 450° C., from 200° C. to 400° C., from 200° C. to 300° C., from 300° C. to 650° C., from 300° C. to 600° C., from 300° C. to 575° C., from 300° C. to 550° C., from 300° C. to 540° C., from 300° C. to 530° C., from 300° C. to 525° C., from 300° C. to 500° C., from 300° C.

to 450° C., from 300° C. to 400° C., from 400° C. to 650° C., from 400° C. to 600° C., from 400° C. to 575° C., from 400° C. to 550° C., from 400° C. to 540° C., from 400° C. to 530° C., from 400° C. to 525° C., from 400° C. to 500° C., from 450° C. to 650° C., from 450° C. to 600° C., from 450° C. to 575° C., from 450° C. to 550° C., from 450° C. to 540° C., from 450° C. to 530° C., from 450° C. to 525° C., from 450° C. to 500° C., from 500° C. to 650° C., from 500° C. to 600° C., from 500° C. to 575° C., from 500° C. to 550° C., from 500° C. to 540° C., from 500° C. to 530° C., from 500° C. to 525° C., from 525° C. to 650° C., from 525° C. to 600° C., from 525° C. to 575° C., from 525° C. to 550° C., from 525° C. to 540° C., from 525° C. to 530° C., from 530° C. to 650° C., from 530° C. to 600° C., from 530° C. to 575° C., from 530° C. to 550° C., from 530° C. to 540° C., from 540° C. to 650° C., from 540° C. to 600° C., from 540° C. to 575° C., from 540° C. to 550° C., from 550° C. to 650° C., from 550° C. to 600° C., from 550° C. to 575° C., from 575° C. to 650° C., from 575° C. to 600° C., or from 600° C. to 650° C., where the $T_{90}$ TBP is greater than the $T_5$ TBP previously described. The upgraded product 152 may have an API gravity from 12° to 45°, from 12° to 35°, from 12° to 30°, from 12° to 27°, from 12° to 25°, from 12° to 23°, from 12° to 21°, from 12° to 20°, from 15° to 45°, from 15° to 35°, from 15° to 30°, from 15° to 27°, from 15° to 25°, from 15° to 23°, from 15° to 21°, from 15° to 20°, from 18° to 45°, from 18° to 35°, from 18° to 30°, from 18° to 27°, from 18° to 25°, from 18° to 23°, from 18° to 21°, from 18° to 20, from 20° to 45°, from 20° to 35°, from 20° to 30°, from 20° to 27°, from 20° to 25°, from 20° to 23°, from 20° to 21°, from 21° to 45°, from 21° to 35°, from 21° to 30°, from 21° to 27°, from 21° to 25°, from 21° to 23°, from 23° to 45°, from 23° to 35°, from 23° to 30°, from 23° to 27°, from 23° to 25°, approximately 20°, or approximately 19.8°. The upgraded product 152 may include less than 3.4 wt. % total sulfur content by weight of the upgraded product 152. In embodiments, the upgraded product 152 may include from 0.1 wt. % to 5 wt. %, from 0.1 wt. % to 4 wt. %, from 0.1 wt. % to 3.3 wt. %, from 0.1 wt. % to 3.0 wt. %, from 0.1 wt. % to 2.8 wt. %, from 0.1 wt. % to 2.6 wt. %, from 0.1 wt. % to 2.3 wt. %, from 0.1 wt. % to 2.0 wt. %, from 0.1 wt. % to 1.8 wt. %, from 0.1 wt. % to 1.6 wt. %, from 0.1 wt. % to 1.3 wt. %, from 0.1 wt. % to 1.0 wt. %, from 0.1 wt. % to 0.5 wt. %, from 0.5 wt. % to 5 wt. %, from 0.5 wt. % to 4 wt. %, from 0.5 wt. % to 3.3 wt. %, from 0.5 wt. % to 3.0 wt. %, from 0.5 wt. % to 2.8 wt. %, from 0.5 wt. % to 2.6 wt. %, from 0.5 wt. % to 2.3 wt. %, from 0.5 wt. % to 2.0 wt. %, from 0.5 wt. % to 1.8 wt. %, from 0.5 wt. % to 1.6 wt. %, from 0.5 wt. % to 1.3 wt. %, from 0.5 wt. % to 1.0 wt. %, from 1.0 wt. % to 5 wt. %, from 1.0 wt. % to 4 wt. %, from 1.0 wt. % to 3.3 wt. %, from 1.0 wt. % to 3.0 wt. %, from 1.0 wt. % to 2.8 wt. %, from 1.0 wt. % to 2.6 wt. %, from 1.0 wt. % to 2.3 wt. %, from 1.0 wt. % to 2.0 wt. %, from 1.0 wt. % to 1.8 wt. %, from 1.0 wt. % to 1.6 wt. %, from 1.0 wt. % to 1.3 wt. %, from 1.3 wt. % to 5 wt. %, from 1.3 wt. % to 4 wt. %, from 1.3 wt. % to 3.3 wt. %, from 1.3 wt. % to 3.0 wt. %, from 1.3 wt. % to 2.8 wt. %, from 1.3 wt. % to 2.6 wt. %, from 1.3 wt. % to 2.3 wt. %, from 1.3 wt. % to 2.0 wt. %, from 1.3 wt. % to 1.8 wt. %, from 1.3 wt. % to 1.6 wt. %, from 1.6 wt. % to 5 wt. %, from 1.6 wt. % to 4 wt. %, from 1.6 wt. % to 3.3 wt. %, from 1.6 wt. % to 3.0 wt. %, from 1.6 wt. % to 2.8 wt. %, from 1.6 wt. % to 2.6 wt. %, from 1.6 wt. % to 2.3 wt. %, from 1.6 wt. % to 2.0 wt. %, from 1.6 wt. % to 1.8 wt. %, from 1.8 wt. % to 5 wt. %, from 1.8 wt. % to 4 wt. %, from 1.8 wt. % to 3.3 wt. %, from 1.8 wt. % to 3.0 wt. %, from 1.8 wt. % to 2.8 wt. %, from 1.8 wt. % to 2.6 wt. %, from 1.8 wt. % to 2.3 wt. %, from 1.8 wt. % to 2.0 wt. %, from 2.0 wt. % to 5 wt. %, from 2.0 wt. % to 4 wt. %, from 2.0 wt. % to 3.3 wt. %, from 2.0 wt. % to 3.0 wt. %, from 2.0 wt. % to 2.8 wt. %, from 2.0 wt. % to 2.6 wt. %, from 2.0 wt. % to 2.3 wt. %, from 2.3 wt. % to 5 wt. %, from 2.3 wt. % to 4 wt. %, from 2.3 wt. % to 3.3 wt. %, from 2.3 wt. % to 3.0 wt. %, from 2.3 wt. % to 2.8 wt. %, from 2.3 wt. % to 2.6 wt. %, from 2.6 wt. % to 5 wt. %, from 2.6 wt. % to 4 wt. %, from 2.6 wt. % to 3.3 wt. %, from 2.6 wt. % to 3.0 wt. %, from 2.6 wt. % to 2.8 wt. %, from 2.8 wt. % to 5 wt. %, from 2.8 wt. % to 4 wt. %, from 2.8 wt. % to 3.3 wt. %, from 2.8 wt. % to 3.0 wt. %, from 3.0 wt. % to 5 wt. %, from 3.0 wt. % to 4 wt. %, from 3.0 wt. % to 3.3 wt. %, or approximately 2.7 wt. % wt. % total sulfur content by weight of the upgraded product 152. The upgraded product 152 may include less than 1.2 wt. % wt. % total nitrogen content by weight of the upgraded product 152. In embodiments, the upgraded product 152 may include from 0.01 wt. % to 2 wt. %, from 0.01 wt. % to 1.1 wt. %, from 0.01 wt. % to 1.0 wt. %, from 0.01 wt. % to 0.8 wt. %, from 0.01 wt. % to 0.6 wt. %, from 0.01 wt. % to 0.4 wt. %, from 0.01 wt. % to 0.2 wt. %, from 0.01 wt. % to 0.1 wt. %, from 0.1 wt. % to 2 wt. %, from 0.1 wt. % to 1.1 wt. %, from 0.1 wt. % to 1.0 wt. %, from 0.1 wt. % to 0.8 wt. %, from 0.1 wt. % to 0.6 wt. %, from 0.1 wt. % to 0.4 wt. %, from 0.1 wt. % to 0.2 wt. %, from 0.2 wt. % to 2 wt. %, from 0.2 wt. % to 1.1 wt. %, from 0.2 wt. % to 1.0 wt. %, from 0.2 wt. % to 0.8 wt. %, from 0.2 wt. % to 0.6 wt. %, from 0.2 wt. % to 0.4 wt. %, from 0.4 wt. % to 2 wt. %, from 0.4 wt. % to 1.1 wt. %, from 0.4 wt. % to 1.0 wt. %, from 0.4 wt. % to 0.8 wt. %, from 0.4 wt. % to 0.6 wt. %, from 0.6 wt. % to 2 wt. %, from 0.6 wt. % to 1.1 wt. %, from 0.6 wt. % to 1.0 wt. %, from 0.6 wt. % to 0.8 wt. %, from 0.8 wt. % to 2 wt. %, from 0.8 wt. % to 1.1 wt. %, from 0.8 wt. % to 1.0 wt. %, from 1.0 wt. % to 2 wt. %, from 1.0 wt. % to 1.1 wt. %, or approximately 0.9 wt. % wt. % total nitrogen content by weight of the upgraded product 152. The upgraded product 152 may include less than 4.8 wt. % asphaltene (heptane-insoluble) by weight of the upgraded product 152. In embodiments, the upgraded product 152 may include from 0.01 wt. % to 6 wt. %, from 0.01 wt. % to 5 wt. %, from 0.01 wt. % to 4.7 wt. %, from 0.01 wt. % to 4.0 wt. %, from 0.01 wt. % to 3.0 wt. %, from 0.01 wt. % to 2.5 wt. %, from 0.01 wt. % to 2.0 wt. %, from 0.01 wt. % to 1.8 wt. %, from 0.01 wt. % to 1.6 wt. %, from 0.01 wt. % to 1.0 wt. %, from 0.01 wt. % to 0.8 wt. %, from 0.01 wt. % to 0.6 wt. %, from 0.01 wt. % to 0.4 wt. %, from 0.01 wt. % to 0.2 wt. %, from 0.01 wt. % to 0.1 wt. %, from 0.1 wt. % to 6 wt. %, from 0.1 wt. % to 5 wt. %, from 0.1 wt. % to 4.7 wt. %, from 0.1 wt. % to 4.0 wt. %, from 0.1 wt. % to 3.0 wt. %, from 0.1 wt. % to 2.5 wt. %, from 0.1 wt. % to 2.0 wt. %, from 0.1 wt. % to 1.8 wt. %, from 0.1 wt. % to 1.6 wt. %, from 0.1 wt. % to 1.0 wt. %, from 0.1 wt. % to 0.8 wt. %, from 0.1 wt. % to 0.6 wt. %, from 0.1 wt. % to 0.4 wt. %, from 0.1 wt. % to 0.2 wt. %, from 0.2 wt. % to 6 wt. %, from 0.2 wt. % to 5 wt. %, from 0.2 wt. % to 4.7 wt. %, from 0.2 wt. % to 4.0 wt. %, from 0.2 wt. % to 3.0 wt. %, from 0.2 wt. % to 2.5 wt. %, from 0.2 wt. % to 2.0 wt. %, from 0.2 wt. % to 1.8 wt. %, from 0.2 wt. % to 1.6 wt. %, from 0.2 wt. % to 1.0 wt. %, from 0.2 wt. % to 0.8 wt. %, from 0.2 wt. % to 0.6 wt. %, from 0.2 wt. % to 0.4 wt. %, from 0.4 wt. % to 6 wt. %, from 0.4 wt. % to 5 wt. %, from 0.4 wt. % to 4.7 wt. %, from 0.4 wt. % to 4.0 wt. %, from 0.4 wt. % to 3.0 wt. %, from 0.4 wt. % to 2.5 wt. %, from 0.4 wt. % to 2.0 wt. %, from 0.4 wt. % to 1.8 wt. %, from 0.4 wt. % to 1.6 wt. %, from 0.4 wt. % to 1.0 wt. %, from 0.4 wt. % to 0.8 wt. %, from 0.4 wt. % to 0.6 wt. %, from 0.6 wt. % to 6 wt.

%, from 0.6 wt. % to 5 wt. %, from 0.6 wt. % to 4.7 wt. %, from 0.6 wt. % to 4.0 wt. %, from 0.6 wt. % to 3.0 wt. %, from 0.6 wt. % to 2.5 wt. %, from 0.6 wt. % to 2.0 wt. %, from 0.6 wt. % to 1.8 wt. %, from 0.6 wt. % to 1.6 wt. %, from 0.6 wt. % to 1.0 wt. %, from 0.6 wt. % to 0.8 wt. %, from 0.8 wt. % to 6 wt. %, from 0.8 wt. % to 5 wt. %, from 0.8 wt. % to 4.7 wt. %, from 0.8 wt. % to 4.0 wt. %, from 0.8 wt. % to 3.0 wt. %, from 0.8 wt. % to 2.5 wt. %, from 0.8 wt. % to 2.0 wt. %, from 0.8 wt. % to 1.8 wt. %, from 0.8 wt. % to 1.6 wt. %, from 0.8 wt. % to 1.0 wt. %, from 1.0 wt. % to 6 wt. %, from 1.0 wt. % to 5 wt. %, from 1.0 wt. % to 4.7 wt. %, from 1.0 wt. % to 4.0 wt. %, from 1.0 wt. % to 3.0 wt. %, from 1.0 wt. % to 2.5 wt. %, from 1.0 wt. % to 2.0 wt. %, from 1.0 wt. % to 1.8 wt. %, from 1.0 wt. % to 1.6 wt. %, from 1.6 wt. % to 6 wt. %, from 1.6 wt. % to 5 wt. %, from 1.6 wt. % to 4.7 wt. %, from 1.6 wt. % to 4.0 wt. %, from 1.6 wt. % to 3.0 wt. %, from 1.6 wt. % to 2.5 wt. %, from 1.6 wt. % to 2.0 wt. %, from 1.6 wt. % to 1.8 wt. %, from 1.8 wt. % to 6 wt. %, from 1.8 wt. % to 5 wt. %, from 1.8 wt. % to 4.7 wt. %, from 1.8 wt. % to 4.0 wt. %, from 1.8 wt. % to 3.0 wt. %, from 1.8 wt. % to 2.5 wt. %, from 1.8 wt. % to 2.0 wt. %, from 2.0 wt. % to 6 wt. %, from 2.0 wt. % to 5 wt. %, from 2.0 wt. % to 4.7 wt. %, from 2.0 wt. % to 4.0 wt. %, from 2.0 wt. % to 3.0 wt. %, from 2.0 wt. % to 2.5 wt. %, from 2.5 wt. % to 6 wt. %, from 2.5 wt. % to 5 wt. %, from 2.5 wt. % to 4.7 wt. %, from 2.5 wt. % to 4.0 wt. %, from 2.5 wt. % to 3.0 wt. %, from 3.0 wt. % to 6 wt. %, from 3.0 wt. % to 5 wt. %, from 3.0 wt. % to 4.7 wt. %, from 3.0 wt. % to 4.0 wt. %, from 4.0 wt. % to 6 wt. %, from 4.0 wt. % to 5 wt. %, or approximately 1.7 wt. % asphaltene (heptane-insoluble) by weight of the upgraded product 152. The upgraded product 152 may include less than 83 parts per million (ppm) metals. In embodiments, the metals may be vanadium, nickel, or both. In embodiments, the upgraded product 152 may include from 1 ppm to 100 ppm, from 1 ppm to 82 ppm, from 1 ppm to 50 ppm, from 1 ppm to 25 ppm, from 1 ppm to 15 ppm, from 1 ppm to 10 ppm, from 1 ppm to 8 ppm, from 1 ppm to 5 ppm, from 1 ppm to 3 ppm, from 3 ppm to 100 ppm, from 3 ppm to 82 ppm, from 3 ppm to 50 ppm, from 3 ppm to 25 ppm, from 3 ppm to 15 ppm, from 3 ppm to 10 ppm, from 3 ppm to 8 ppm, from 3 ppm to 5 ppm, from 5 ppm to 100 ppm, from 5 ppm to 82 ppm, from 5 ppm to 50 ppm, from 5 ppm to 25 ppm, from 5 ppm to 15 ppm, from 5 ppm to 10 ppm, from 5 ppm to 8 ppm, from 8 ppm to 100 ppm, from 8 ppm to 82 ppm, from 8 ppm to 50 ppm, from 8 ppm to 25 ppm, from 8 ppm to 15 ppm, from 8 ppm to 10 ppm, from 10 ppm to 100 ppm, from 10 ppm to 82 ppm, from 10 ppm to 50 ppm, from 10 ppm to 25 ppm, from 10 ppm to 15 ppm, from 15 ppm to 100 ppm, from 15 ppm to 82 ppm, from 15 ppm to 50 ppm, from 15 ppm to 25 ppm, or approximately 9 ppm metals. The upgraded product 152 may have a viscosity at 50° C. of less than 640 centiStokes (cSt). In embodiments, the upgraded product 152 may have a viscosity at 50° C. from 10 to 639 cSt, from 10 cSt to 600 cSt, from 10 cSt to 400 cSt, from 10 cSt to 200 cSt, from 10 cSt to 150 cSt, from 10 cSt to 100 cSt, from 10 cSt to 90 cSt, from 10 cSt to 88 cSt, from 10 cSt to 70 cSt, from 10 cSt to 50 cSt, from 10 cSt to 35 cSt, from 10 cSt to 28 cSt, from 10 cSt to 26 cSt, from 10 cSt to 20 cSt, from 20 cSt to 639 cSt, from 20 cSt to 600 cSt, from 20 cSt to 400 cSt, from 20 cSt to 200 cSt, from 20 cSt to 150 cSt, from 20 cSt to 100 cSt, from 20 cSt to 90 cSt, from 20 cSt to 88 cSt, from 20 cSt to 70 cSt, from 20 cSt to 50 cSt, from 20 cSt to 35 cSt, from 20 cSt to 28 cSt, from 20 cSt to 26 cSt, from 26 cSt to 639 cSt, from 26 cSt to 600 cSt, from 26 cSt to 400 cSt, from 26 cSt to 200 cSt, from 26 cSt to 150 cSt, from 26 cSt to 100 cSt, from 26 cSt to 90 cSt, from 26 cSt to 88 cSt, from 26 cSt to 70 cSt, from 26 cSt to 50 cSt, from 26 cSt to 35 cSt, from 26 cSt to 28 cSt, from 28 cSt to 639 cSt, from 28 cSt to 600 cSt, from 28 cSt to 400 cSt, from 28 cSt to 200 cSt, from 28 cSt to 150 cSt, from 28 cSt to 100 cSt, from 28 cSt to 90 cSt, from 28 cSt to 88 cSt, from 28 cSt to 70 cSt, from 28 cSt to 50 cSt, from 28 cSt to 35 cSt, from 35 cSt to 639 cSt, from 35 cSt to 600 cSt, from 35 cSt to 400 cSt, from 35 cSt to 200 cSt, from 35 cSt to 150 cSt, from 35 cSt to 100 cSt, from 35 cSt to 90 cSt, from 35 cSt to 88 cSt, from 35 cSt to 70 cSt, from 35 cSt to 50 cSt, from 50 cSt to 639 cSt, from 50 cSt to 600 cSt, from 50 cSt to 400 cSt, from 50 cSt to 200 cSt, from 50 cSt to 150 cSt, from 50 cSt to 100 cSt, from 50 cSt to 90 cSt, from 50 cSt to 88 cSt, from 50 cSt to 70 cSt, from 70 cSt to 639 cSt, from 70 cSt to 600 cSt, from 70 cSt to 400 cSt, from 70 cSt to 200 cSt, from 70 cSt to 150 cSt, from 70 cSt to 100 cSt, from 70 cSt to 90 cSt, from 70 cSt to 88 cSt, from 88 cSt to 639 cSt, from 88 cSt to 600 cSt, from 88 cSt to 400 cSt, from 88 cSt to 200 cSt, from 88 cSt to 150 cSt, from 88 cSt to 100 cSt, from 88 cSt to 90 cSt, or approximately 89 cSt.

The upgraded product 152 may then be cooled by cooler 154 to a temperature from 150° C. to 250° C., from 150° C. to 225° C., from 150° C. to 200° C., from 150° C. to 175° C., from 175° C. to 250° C., from 175° C. to 225° C., from 175° C. to 200° C., from 200° C. to 250° C., from 200° C. to 225° C., or from 225° C. to 250° C. to form a cooled, upgraded product 156. Various cooling devices are contemplated for the cooler 154, such as a heat exchanger.

Figure 2:
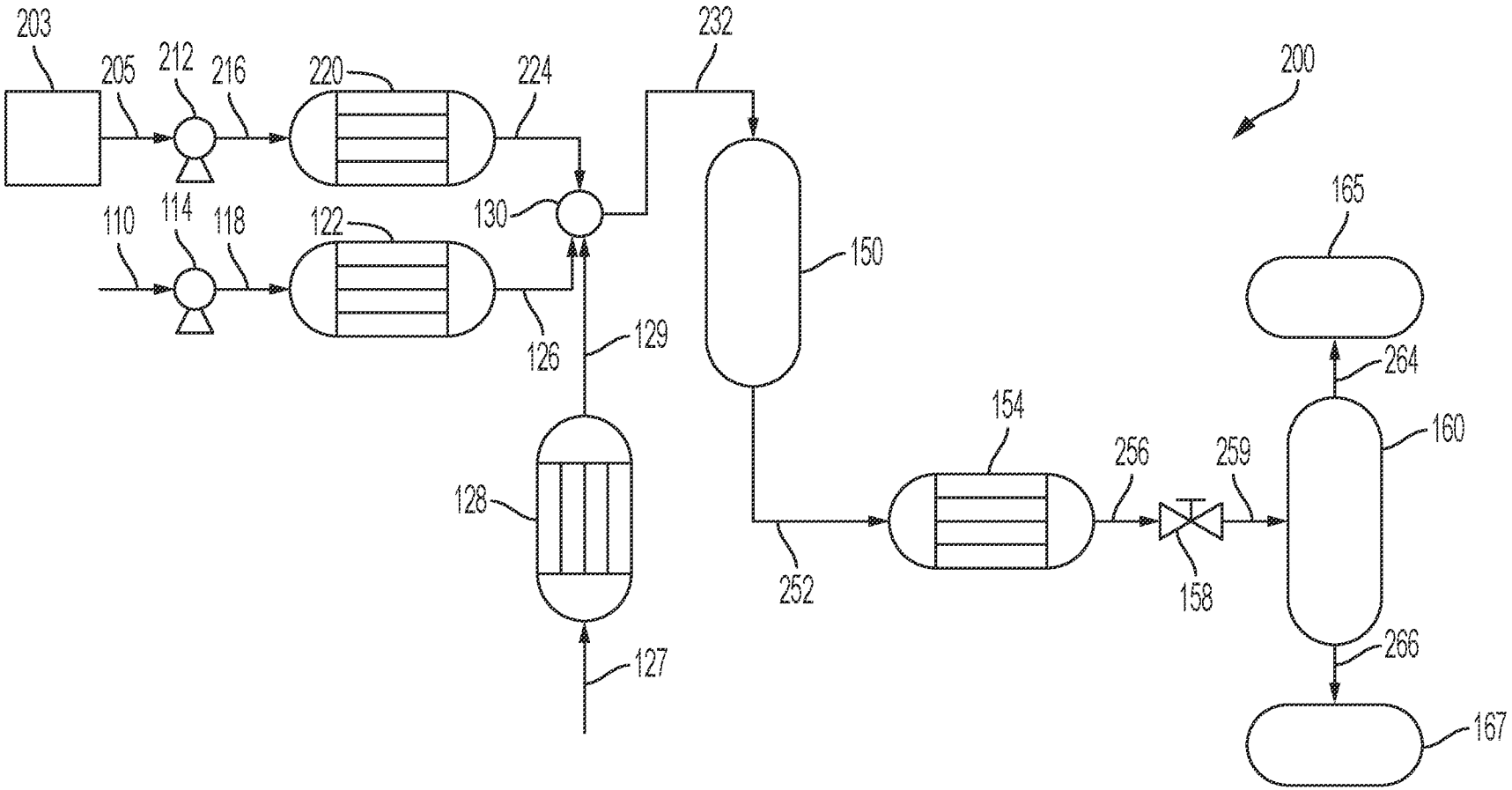
FIG. 2 is a schematic view of a process for treating a disulfide oil composition, according to the present embodiments.

Referring again to FIG. 1, upon exiting the cooler 154, the pressure of the cooled, upgraded product 156 may be reduced MPa to create a depressurized, upgraded product 159, which may have a pressure from 0.01 MPa to 1.0 MPa, from 0.01 MPa to 0.8 MPa, from 0.01 MPa to 0.5 MPa, from 0.01 MPa to 0.3 MPa, from 0.01 MPa to 0.1 MPa, from 0.01 MPa to 0.08 MPa, from 0.01 MPa to 0.05 MPa, from 0.01 MPa to 0.03 MPa, from 0.03 MPa to 1.0 MPa, from 0.03 MPa to 0.8 MPa, from 0.03 MPa to 0.5 MPa, from 0.03 MPa to 0.3 MPa, from 0.03 MPa to 0.1 MPa, from 0.03 MPa to 0.08 MPa, from 0.03 MPa to 0.05 MPa, from 0.05 MPa to 1.0 MPa, from 0.05 MPa to 0.8 MPa, from 0.05 MPa to 0.5 MPa, from 0.05 MPa to 0.3 MPa, from 0.05 MPa to 0.1 MPa, from 0.05 MPa to 0.08 MPa, from 0.08 MPa to 1.0 MPa, from 0.08 MPa to 0.8 MPa, from 0.08 MPa to 0.5 MPa, from 0.08 MPa to 0.3 MPa, from 0.08 MPa to 0.1 MPa, from 0.1 MPa to 1.0 MPa, from 0.1 MPa to 0.8 MPa, from 0.1 MPa to 0.5 MPa, from 0.1 MPa to 0.3 MPa, from 0.3 MPa to 1.0 MPa, from 0.3 MPa to 0.8 MPa, from 0.3 MPa to 0.5 MPa, from 0.5 MPa to 1.0 MPa, from 0.5 MPa to 0.8 MPa, or from 0.8 MPa to 1.0 MPa. The depressurizing can be achieved by many devices, for example, a valve 158 as shown in FIGS. 1 and 2.

The depressurized, upgraded product 159 may then be passed to a gas/oil/water separator 160. The gas/water separator 160 may separate the depressurized, upgraded product 159 into a first gas fraction 164, a liquid oil fraction 162, and a first water fraction 166. The gas/water separator 160 may be any separator known in the industry. While the gas/oil/water separator 160 may separate the depressurized, upgraded product 159 into at least a first gas fraction 164 comprising CO, $CO_2$, $NH_3$, $H_2$, $H_2S$, $C_1$, $C_2$, $C_3$, $C_4$, $C_5$, $C_6$, or combinations thereof; a liquid oil fraction 162; and a first water fraction 166, it should be appreciated that additional fractions may also be produced. In embodiments, the first gas fraction 164 may include from 0.5 wt. % to 3 wt. %, from 0.5 wt. % to 2 wt. %, from 0.5 wt. % to 1.5 wt. %, 0.5 wt. % to 1.2 wt. %, from 0.8 wt. % to 3 wt. %, from 0.8 wt.

% to 2 wt. %, from 0.8 wt. % to 1.5 wt. %, from 0.8 wt. % to 1.2 wt. %, or approximately 1 wt. % $H_2$ by weight of the first gas fraction 164. In embodiments, the first gas fraction 164 may include from 2 wt. % to 50 wt. %, from 2 wt. % to 25 wt. %, from 5 wt. % to 50 wt. %, from 5 wt. % to 25 wt. %, from 5 wt. % to 15 wt. %, from 5 wt. % to 13 wt. %, from 8 wt. % to 50 wt. %, from 8 wt. % to 25 wt. %, from 8 wt. % to 15 wt. %, from 8 wt. % to 13 wt. %, from 10 wt. % to 50 wt. %, from 10 wt. % to 25 wt. %, from 10 wt. % to 15 wt. %, from 10 wt. % to 13 wt. %, from 11 wt. % to 50 wt. %, from 11 wt. % to 25 wt. %, from 11 wt. % to 15 wt. %, from 11 wt. % to 13 wt. %, or approximately 12 wt. % $C_1$ by weight of the first gas fraction 164. In embodiments, the first gas fraction 164 may include from 2 wt. % to 50 wt. %, from 2 wt. % to 25 wt. %, from 5 wt. % to 50 wt. %, from 5 wt. % to 25 wt. %, from 5 wt. % to 15 wt. %, from 5 wt. % to 12 wt. %, from 8 wt. % to 15 wt. %, from 8 wt. % to 12 wt. %, from 10 wt. % to 15 wt. %, from 10 wt. % to 12 wt. %, or approximately 11 wt. % $C_2$ by weight of the first gas fraction 164. In embodiments, the first gas fraction 164 may include from 2 wt. % to 50 wt. %, from 2 wt. % to 25 wt. %, from 2 wt. % to 15 wt. %, from 5 wt. % to 50 wt. %, from 5 wt. % to 25 wt. %, from 5 wt. % to 15 wt. %, from 5 wt. % to 13 wt. %, from 5 wt. % to 11 wt. %, from 7 wt. % to 15 wt. %, from 7 wt. % to 13 wt. %, from 7 wt. % to 11 wt. %, from 9 wt. % to 15 wt. %, from 9 wt. % to 13 wt. %, from 9 wt. % to 11 wt. %, or approximately 10 wt. % $C_3$ by weight of the first gas fraction 164. In embodiments, the first gas fraction 164 may include from 1 wt. % to 50 wt. %, from 1 wt. % to 25 wt. %, from 3 wt. % to 15 wt. %, from 3 wt. % to 12 wt. %, from 3 wt. % to 10 wt. %, from 5 wt. % to 15 wt. %, from 5 wt. % to 12 wt. %, from 5 wt. % to 10 wt. %, from 8 wt. % to 15 wt. %, from 8 wt. % to 12 wt. %, from 8 wt. % to 10 wt. %, or approximately 9 wt. % $C_4$ by weight of the first gas fraction 164. In embodiments, the first gas fraction 164 may include from 0 wt. % to 50 wt. %, from 0 wt. % to 25 wt. %, from 0 wt. % to 10 wt. %, from 0 wt. % to 5 wt. %, from 0 wt. % to 1 wt. %, from 1 wt. % to 15 wt. %, from 1 wt. % to 10 wt. %, from 1 wt. % to 8 wt. %, from 3 wt. % to 10 wt. %, from 3 wt. % to 8 wt. %, from 5 wt. % to 15 wt. %, from 5 wt. % to 12 wt. %, from 5 wt. % to 10 wt. %, from 5 wt. % to 8 wt. %, from 6 wt. % to 10 wt. %, from 6 wt. % to 8 wt. %, or approximately 7 wt. % $C_5$ by weight of the first gas fraction 164. The first gas fraction 164 may include from 0 wt. % to 25 wt. %, from 0 wt. % to 10 wt. %, from 0 wt. % to 1 wt. %, from 1 wt. % to 25 wt. %, from 1 wt. % to 10 wt. %, from 1 wt. % to 7 wt. %, from 1 wt. % to 5 wt. %, from 2 wt. % to 10 wt. %, from 2 wt. % to 7 wt. %, from 2 wt. % to 5 wt. %, from 3 wt. % to 10 wt. %, from 3 wt. % to 7 wt. %, from 3 wt. % to 5 wt. %, or approximately 4 wt. % $C_6$ by weight of the first gas fraction 164. In embodiments, the first gas fraction 164 may include from 0 wt. % to 15 wt. %, from 1 wt. % to 10 wt. %, from 1 wt. % to 5 wt. %, from 1 wt. % to 3 wt. %, or approximately 2 wt. % CO by weight of the first gas fraction 164. In embodiments, the first gas fraction 164 may include from 0 wt. % to 25 wt. %, from 0 wt. % to 10 wt. %, from 0 wt. % to 1 wt. %, from 1 wt. % to 25 wt. %, from 1 wt. % to 10 wt. %, from 1 wt. % to 7 wt. %, from 1 wt. % to 5 wt. %, from 2 wt. % to 10 wt. %, from 2 wt. % to 7 wt. %, from 2 wt. % to 5 wt. %, from 3 wt. % to 10 wt. %, from 3 wt. % to 7 wt. %, from 3 wt. % to 5 wt. %, or approximately 4 wt. % $CO_2$ by weight of the first gas fraction 164. In embodiments, the first gas fraction 164 may include from 1 wt. % to 50 wt. %, from 1 wt. % to 35 wt. %, from 1 wt. % to 30 wt. %, from 1 wt. % to 26 wt. %, from 10 wt. % to 50 wt. %, from 10 wt. % to 35 wt. %, from 10 wt. % to 30 wt. %, from 10 wt. % to 26 wt. %, from 15 wt. % to 50 wt. %, from 15 wt. % to 35 wt. %, from 15 wt. % to 30 wt. %, from 15 wt. % to 26 wt. %, from 20 wt. % to 50 wt. %, from 20 wt. % to 35 wt. %, from 20 wt. % to 30 wt. %, from 20 wt. % to 26 wt. %, from 23 wt. % to 50 wt. %, from 23 wt. % to 35 wt. %, from 23 wt. % to 30 wt. %, from 23 wt. % to 26 wt. %, from 25 wt. % to 50 wt. %, from 25 wt. % to 35 wt. %, from 25 wt. % to 30 wt. %, from 25 wt. % to 26 wt. %, or approximately 25.6 wt. % $H_2S$ by weight of the first gas fraction 164. In embodiments, the first gas fraction 164 may include from 1 wt. % to 50 wt. %, from 1 wt. % to 25 wt. %, from 1 wt. % to 20 wt. %, from 1 wt. % to 15 wt. %, from 5 wt. % to 50 wt. %, from 5 wt. % to 25 wt. %, from 5 wt. % to 20 wt. %, from 5 wt. % to 15 wt. %, from 10 wt. % to 50 wt. %, from 10 wt. % to 25 wt. %, from 10 wt. % to 20 wt. %, from 10 wt. % to 15 wt. %, from 12 wt. % to 50 wt. %, from 12 wt. % to 25 wt. %, from 12 wt. % to 20 wt. %, from 12 wt. % to 15 wt. %, from 14 wt. % to 50 wt. %, from 14 wt. % to 25 wt. %, from 14 wt. % to 20 wt. %, from 14 wt. % to 15 wt. %, or approximately 14.6 wt. % $NH_3$ by weight of the first gas fraction 164. In embodiments, the first gas fraction 164 may include no $C_5$ or $C_6$ components. In embodiments, the liquid oil fraction 162 may have a $T_5$ true boiling point (TBP) of less than 500° C., of less than 400° C., of less than 350° C., of less than 325° C., of less than 300° C., of less than 275° C., or of less than 260° C. In embodiments, the liquid oil fraction 162 may have a $T_5$ TBP of from 25° C. to 350° C., from 25° C. to 325° C., from 25° C. to 300° C., from 25° C. to 275° C., from 25° C. to 250° C., from 25° C. to 225° C., from 25° C. to 200° C., from 25° C. to 175° C., from 25° C. to 150° C., from 25° C. to 125° C., from 25° C. to 100° C., from 25° C. to 75° C., from 25° C. to 50° C., from 50° C. to 350° C., from 50° C. to 325° C., from 50° C. to 300° C., from 50° C. to 275° C., from 50° C. to 250° C., from 50° C. to 225° C., from 50° C. to 200° C., from 50° C. to 175° C., from 50° C. to 150° C., from 50° C. to 125° C., from 50° C. to 100° C., from 50° C. to 75° C., from 75° C. to 350° C., from 75° C. to 325° C., from 75° C. to 300° C., from 75° C. to 275° C., from 75° C. to 250° C., from 75° C. to 225° C., from 75° C. to 200° C., from 75° C. to 175° C., from 75° C. to 150° C., from 75° C. to 125° C., from 75° C. to 100° C., from 100° C. to 350° C., from 100° C. to 325° C., from 100° C. to 300° C., from 100° C. to 275° C., from 100° C. to 250° C., from 100° C. to 225° C., from 100° C. to 200° C., from 100° C. to 175° C., from 100° C. to 150° C., from 100° C. to 125° C., from 125° C. to 350° C., from 125° C. to 325° C., from 125° C. to 300° C., from 125° C. to 275° C., from 125° C. to 250° C., from 125° C. to 225° C., from 125° C. to 200° C., from 125° C. to 175° C., from 125° C. to 150° C., from 150° C. to 350° C., from 150° C. to 325° C., from 150° C. to 300° C., from 150° C. to 275° C., from 150° C. to 250° C., from 150° C. to 225° C., from 150° C. to 200° C., from 150° C. to 175° C., from 175° C. to 350° C., from 175° C. to 325° C., from 175° C. to 300° C., from 175° C. to 275° C., from 175° C. to 250° C., from 175° C. to 225° C., from 175° C. to 200° C., from 200° C. to 350° C., from 200° C. to 325° C., from 200° C. to 300° C., from 200° C. to 275° C., from 200° C. to 250° C., from 200° C. to 225° C., from 225° C. to 350° C., from 225° C. to 325° C., from 225° C. to 300° C., from 225° C. to 275° C., from 225° C. to 250° C., from 250° C. to 350° C., from 250° C. to 325° C., from 250° C. to 300° C., from 250° C. to 275° C., from 275° C. to 350° C., from 275° C. to 325° C., from 275° C. to 300° C., from 300° C. to 350° C., from 300° C. to 325° C., or from 325° C. to 350° C. The liquid oil fraction 162 may have a $T_{90}$ TBP of less than or equal to 650° C., less than or equal to 600° C., less than or equal to 575° C., or less than or equal to 550° C. In embodiments, the liquid oil fraction 162 may have a $T_{90}$ TBP from 200° C. to 650° C., from 200° C. to 600° C., from 200° C. to 575° C., from 200° C. to 550° C., from 200° C. to 540° C., from 200° C. to 530° C., from 200° C. to 525° C., from 200° C. to 500° C., from 200° C. to 450° C., from 200° C. to 400° C., from 200° C. to 300° C., from 300° C. to 650° C., from 300° C. to 600° C., from 300° C. to 575° C., from 300° C. to 550° C., from 300° C. to 540° C., from 300° C. to 530° C., from 300° C. to 525° C., from 300° C. to 500° C., from 300° C. to 450° C., from 300° C. to 400° C., from 400° C. to 650° C., from 400° C. to 600° C., from 400° C. to 575° C., from 400° C. to 550° C., from 400° C. to 540° C., from 400° C. to 530° C., from 400° C. to 525° C., from 400° C. to 500° C., from 450° C. to 650° C., from 450° C. to 600° C., from 450° C. to 575° C., from 450° C. to 550° C., from 450° C. to 540° C., from 450° C. to 530° C., from 450° C. to 525° C., from 450° C. to 500° C., from 500° C. to 650° C., from 500° C. to 600° C., from 500° C. to 575° C., from 500° C. to 550° C., from 500° C. to 540° C., from 500° C. to 530° C., from 500° C. to 525° C., from 525° C. to 650° C., from 525° C. to 600° C., from 525° C. to 575° C., from 525° C. to 550° C., from 525° C. to 540° C., from 525° C. to 530° C., from 530° C. to 650° C., from 530° C. to 600° C., from 530° C. to 575° C., from 530° C. to 550° C., from 530° C. to 540° C., from 540° C. to 650° C., from 540° C. to 600° C., from 540° C. to 575° C., from 540° C. to 550° C., from 550° C. to 650° C., from 550° C. to 600° C., from 550° C. to 575° C., from 575° C. to 650° C., from 575° C. to 600° C., or from 600° C. to 650° C., where the $T_{90}$ TBP is greater than the $T_5$ TBP previously described. The liquid oil fraction 162 may have an API gravity from 12° to 45°, from 12° to 35°, from 12° to 30°, from 12° to 27°, from 12° to 25°, from 15° to 45°, from 15° to 35°, from 15° to 30°, from 15° to 27°, from 15° to 25°, from 18° to 45°, from 18° to 35°, from 18° to 30°, from 18° to 27°, from 18° to 25°, from 20° to 45°, from 20° to 35°, from 20° to 30°, from 20° to 27°, from 20° to 25°, from 21° to 45°, from 21° to 35°, from 21° to 30°, from 21° to 27°, from 21° to 25°, from 23° to 45°, from 23° to 35°, from 23° to 30°, from 23° to 27°, from 23° to 25°, or approximately 24°. The liquid oil fraction 162 may include less than 3.4 wt. % or less than 2.7 wt. % total sulfur content by weight of the liquid oil fraction 162. In embodiments, the liquid oil fraction 162 may include from 0.1 wt. % to 5 wt. %, from 0.1 wt. % to 4 wt. %, from 0.1 wt. % to 3.3 wt. %, from 0.1 wt. % to 3.0 wt. %, from 0.1 wt. % to 2.8 wt. %, from 0.1 wt. % to 2.6 wt. %, from 0.1 wt. % to 2.3 wt. %, from 0.1 wt. % to 2.0 wt. %, from 0.1 wt. % to 1.8 wt. %, from 0.1 wt. % to 1.6 wt. %, from 0.1 wt. % to 1.3 wt. %, from 0.1 wt. % to 1.0 wt. %, from 0.1 wt. % to 0.5 wt. %, from 0.5 wt. % to 5 wt. %, from 0.5 wt. % to 4 wt. %, from 0.5 wt. % to 3.3 wt. %, from 0.5 wt. % to 3.0 wt. %, from 0.5 wt. % to 2.8 wt. %, from 0.5 wt. % to 2.6 wt. %, from 0.5 wt. % to 2.3 wt. %, from 0.5 wt. % to 2.0 wt. %, from 0.5 wt. % to 1.8 wt. %, from 0.5 wt. % to 1.6 wt. %, from 0.5 wt. % to 1.3 wt. %, from 0.5 wt. % to 1.0 wt. %, from 1.0 wt. % to 5 wt. %, from 1.0 wt. % to 4 wt. %, from 1.0 wt. % to 3.3 wt. %, from 1.0 wt. % to 3.0 wt. %, from 1.0 wt. % to 2.8 wt. %, from 1.0 wt. % to 2.6 wt. %, from 1.0 wt. % to 2.3 wt. %, from 1.0 wt. % to 2.0 wt. %, from 1.0 wt. % to 1.8 wt. %, from 1.0 wt. % to 1.6 wt. %, from 1.0 wt. % to 1.3 wt. %, from 1.3 wt. % to 5 wt. %, from 1.3 wt. % to 4 wt. %, from 1.3 wt. % to 3.3 wt. %, from 1.3 wt. % to 3.0 wt. %, from 1.3 wt. % to 2.8 wt. %, from 1.3 wt. % to 2.6 wt. %, from 1.3 wt. % to 2.3 wt. %, from 1.3 wt. % to 2.0 wt. %, from 1.3 wt. % to 1.8 wt. %, from 1.3 wt. % to 1.6 wt. %, from 1.6 wt. % to 5 wt. %, from 1.6 wt. % to 4 wt. %, from 1.6 wt. % to 3.3 wt. %, from 1.6 wt. % to 3.0 wt. %, from 1.6 wt. % to 2.8 wt. %, from 1.6 wt. % to 2.6 wt. %, from 1.6 wt. % to 2.3 wt. %, from 1.6 wt. % to 2.0 wt. %, from 1.6 wt. % to 1.8 wt. %, or approximately 1.7 wt. % total sulfur content by weight of the liquid oil fraction 162. The liquid oil fraction 162 may include less than 1.2 wt. % or less than 0.9 wt. % total nitrogen content by weight of the liquid oil fraction 162. In embodiments, the liquid oil fraction 162 may include from 0.01 wt. % to 2 wt. %, from 0.01 wt. % to 1.1 wt. %, from 0.01 wt. % to 1.0 wt. %, from 0.01 wt. % to 0.8 wt. %, from 0.01 wt. % to 0.6 wt. %, from 0.01 wt. % to 0.4 wt. %, from 0.01 wt. % to 0.2 wt. %, from 0.01 wt. % to 0.1 wt. %, from 0.1 wt. % to 2 wt. %, from 0.1 wt. % to 1.1 wt. %, from 0.1 wt. % to 1.0 wt. %, from 0.1 wt. % to 0.8 wt. %, from 0.1 wt. % to 0.6 wt. %, from 0.1 wt. % to 0.4 wt. %, from 0.1 wt. % to 0.2 wt. %, from 0.2 wt. % to 2 wt. %, from 0.2 wt. % to 1.1 wt. %, from 0.2 wt. % to 1.0 wt. %, from 0.2 wt. % to 0.8 wt. %, from 0.2 wt. % to 0.6 wt. %, from 0.2 wt. % to 0.4 wt. %, from 0.4 wt. % to 2 wt. %, from 0.4 wt. % to 1.1 wt. %, from 0.4 wt. % to 1.0 wt. %, from 0.4 wt. % to 0.8 wt. %, from 0.4 wt. % to 0.6 wt. %, or approximately 0.3 wt. % total nitrogen content by weight of the liquid oil fraction 162. The liquid oil fraction 162 may include less than 4.8 wt. % or less than 1.7 wt. % asphaltene (heptane-insoluble) by weight of the liquid oil fraction 162. In embodiments, the liquid oil fraction 162 may include from 0.01 wt. % to 6 wt. %, from 0.01 wt. % to 5 wt. %, from 0.01 wt. % to 4.7 wt. %, from 0.01 wt. % to 4.0 wt. %, from 0.01 wt. % to 3.0 wt. %, from 0.01 wt. % to 2.5 wt. %, from 0.01 wt. % to 2.0 wt. %, from 0.01 wt. % to 1.8 wt. %, from 0.01 wt. % to 1.6 wt. %, from 0.01 wt. % to 1.0 wt. %, from 0.01 wt. % to 0.8 wt. %, from 0.01 wt. % to 0.6 wt. %, from 0.01 wt. % to 0.4 wt. %, from 0.01 wt. % to 0.2 wt. %, from 0.01 wt. % to 0.1 wt. %, from 0.1 wt. % to 6 wt. %, from 0.1 wt. % to 5 wt. %, from 0.1 wt. % to 4.7 wt. %, from 0.1 wt. % to 4.0 wt. %, from 0.1 wt. % to 3.0 wt. %, from 0.1 wt. % to 2.5 wt. %, from 0.1 wt. % to 2.0 wt. %, from 0.1 wt. % to 1.8 wt. %, from 0.1 wt. % to 1.6 wt. %, from 0.1 wt. % to 1.0 wt. %, from 0.1 wt. % to 0.8 wt. %, from 0.1 wt. % to 0.6 wt. %, from 0.1 wt. % to 0.4 wt. %, from 0.1 wt. % to 0.2 wt. %, from 0.2 wt. % to 6 wt. %, from 0.2 wt. % to 5 wt. %, from 0.2 wt. % to 4.7 wt. %, from 0.2 wt. % to 4.0 wt. %, from 0.2 wt. % to 3.0 wt. %, from 0.2 wt. % to 2.5 wt. %, from 0.2 wt. % to 2.0 wt. %, from 0.2 wt. % to 1.8 wt. %, from 0.2 wt. % to 1.6 wt. %, from 0.2 wt. % to 1.0 wt. %, from 0.2 wt. % to 0.8 wt. %, from 0.2 wt. % to 0.6 wt. %, from 0.2 wt. % to 0.4 wt. %, from 0.4 wt. % to 6 wt. %, from 0.4 wt. % to 5 wt. %, from 0.4 wt. % to 4.7 wt. %, from 0.4 wt. % to 4.0 wt. %, from 0.4 wt. % to 3.0 wt. %, from 0.4 wt. % to 2.5 wt. %, from 0.4 wt. % to 2.0 wt. %, from 0.4 wt. % to 1.8 wt. %, from 0.4 wt. % to 1.6 wt. %, from 0.4 wt. % to 1.0 wt. %, from 0.4 wt. % to 0.8 wt. %, from 0.4 wt. % to 0.6 wt. %, or approximately 0.3 wt. % asphaltene (heptane-insoluble) by weight of the liquid oil fraction 162. The upgraded product stream 152 may include less than 83 parts per million (ppm) or less than 9 ppm metals. In embodiments, the metals may be vanadium, nickel, or both. In embodiments, the upgraded product stream 152 may include from 1 ppm to 100 ppm, from 1 ppm to 82 ppm, from 1 ppm to 50 ppm, from 1 ppm to 25 ppm, from 1 ppm to 15 ppm, from 1 ppm to 10 ppm, from 1 ppm to 8 ppm, from 1 ppm to 5 ppm, from 1 ppm to 3 ppm, from 3 ppm to 100 ppm, from 3 ppm to 82 ppm, from 3 ppm to 50 ppm, from 3 ppm to 25 ppm, from 3 ppm to 15 ppm, from 3 ppm to 10 ppm, from 3 ppm to 8 ppm, from 3 ppm to 5 ppm, or approximately 4 ppm metals. The liquid oil fraction 162 may have a viscosity at 50° C. of less than 640 centiStokes (cSt) or less than 89 cSt. In embodiments, the liquid oil fraction 162 may have a viscosity at 50° C. from 10 cSt to 639 cSt, from 10 cSt to 600 cSt, from 10 cSt to 400 cSt, from 10 cSt to 200 cSt, from 10 cSt to 150 cSt, from 10 cSt to 100 cSt, from 10 cSt to 90 cSt, from 10 cSt to 88 cSt, from 10 cSt to 70 cSt, from 10 cSt to 50 cSt, from 10 cSt to 35 cSt, from 10 cSt to 28 cSt, from 10 cSt to 26 cSt, from 10 cSt to 20 cSt, from 20 cSt to 639 cSt, from 20 cSt to 600 cSt, from 20 cSt to 400 cSt, from 20 cSt to 200 cSt, from 20 cSt to 150 cSt, from 20 cSt to 100 cSt, from 20 cSt to 90 cSt, from 20 cSt to 88 cSt, from 20 cSt to 70 cSt, from 20 cSt to 50 cSt, from 20 cSt to 35 cSt, from 20 cSt to 28 cSt, from 20 cSt to 26 cSt, from 26 cSt to 639 cSt, from 26 cSt to 600 cSt, from 26 cSt to 400 cSt, from 26 cSt to 200 cSt, from 26 cSt to 150 cSt, from 26 cSt to 100 cSt, from 26 cSt to 90 cSt, from 26 cSt to 88 cSt, from 26 cSt to 70 cSt, from 26 cSt to 50 cSt, from 26 cSt to 35 cSt, from 26 cSt to 28 cSt, or approximately 27 cSt.

As shown in FIG. 1, the first gas fraction 164 may be passed to a gas storage tank 165, the liquid oil fraction 162 may be passed to an oil storage tank 163, and the first water fraction 166 may be passed to a water storage tank 167.

FIG. 2 schematically depicts a process 200 for treating a disulfide oil composition 205, according to embodiments described. For the reference numbers and descriptions of the process 200 that correlate with previous reference numbers and descriptions for process 100, it is intended that all previous description for process 100 relevant to the reference numbers used in process 200 should be incorporated. For example, and not by way of limitation, water stream 110 in process 200 is meant to correspond and incorporate all previous descriptions of water stream 110 in process 100.

The disulfide oil composition 205 may refer to any disulfide composition. In embodiments, it is contemplated that the disulfide oil composition 205 may be the product of a naphtha and LPG mercaptan oxidation unit 203, which is a refining technology that selectively removes mercaptans sulfur by caustic extraction and generates disulfide oil (RSSR), by oxidizing sulfur rich caustic solution, as byproduct. In embodiments, the disulfide composition 205 may include dimethyl disulfide, methyl ethyl disulfide, methyl isopropyl disulfide, diethyl disulfide, methyl n-propyl disulfide, ethyl isopropyl disulfide, ethyl n-propyl disulfide, di-isopropyl disulfide, ethyl n-butyl disulfide, dipropyl disulfide, dimethyl trisulfide, diethyl trisulfide, methyl propyl trisulfide, di-isopropyl trisulfide, or combinations thereof. It is noted that different components may have different names but the same chemical formula.

The disulfide oil composition 205 may include from 5 wt. % to 50 wt. %, from 5 wt. % to 25 wt. %, from 5 wt. % to 20 wt. %, from 5 wt. % to 18 wt. %, from 5 wt. % to 15 wt. %, from 5 wt. % to 13 wt. %, from 5 wt. % to 10 wt. %, from 5 wt. % to 8 wt. %, from 8 wt. % to 50 wt. %, from 8 wt. % to 25 wt. %, from 8 wt. % to 20 wt. %, from 8 wt. % to 18 wt. %, from 8 wt. % to 15 wt. %, from 8 wt. % to 13 wt. %, from 8 wt. % to 10 wt. %, from 10 wt. % to 50 wt. %, from 10 wt. % to 25 wt. %, from 10 wt. % to 20 wt. %, from 10 wt. % to 18 wt. %, from 10 wt. % to 15 wt. %, from 10 wt. % to 13 wt. %, from 13 wt. % to 50 wt. %, from 13 wt. % to 25 wt. %, from 13 wt. % to 20 wt. %, from 13 wt. % to 18 wt. %, from 13 wt. % to 15 wt. %, from 15 wt. % to 50 wt. %, from 15 wt. % to 25 wt. %, from 15 wt. % to 20 wt. %, from 15 wt. % to 18 wt. %, from 18 wt. % to 50 wt. %, from 18 wt. % to 25 wt. %, from 18 wt. % to 20 wt. %, from 20 wt. % to 50 wt. %, from 20 wt. % to 25 wt. %, from 25 wt. % to 50 wt. %, or approximately 14 wt. % $C_2H_6S_2$ by weight of the disulfide oil composition 205. In embodiments, $C_2H_6S_2$ may include dimethyl disulfide.

The disulfide oil composition 205 may include from 10 wt. % to 50 wt. %, from 10 wt. % to 40 wt. %, from 10 wt. % to 35 wt. %, from 10 wt. % to 30 wt. %, from 10 wt. % to 28 wt. %, from 10 wt. % to 25 wt. %, from 10 wt. % to 23 wt. %, from 10 wt. % to 20 wt. %, from 10 wt. % to 15 wt. %, from 15 wt. % to 50 wt. %, from 15 wt. % to 40 wt. %, from 15 wt. % to 35 wt. %, from 15 wt. % to 30 wt. %, from 15 wt. % to 28 wt. %, from 15 wt. % to 25 wt. %, from 15 wt. % to 23 wt. %, from 15 wt. % to 20 wt. %, from 20 wt. % to 50 wt. %, from 20 wt. % to 40 wt. %, from 20 wt. % to 35 wt. %, from 20 wt. % to 30 wt. %, from 20 wt. % to 28 wt. %, from 20 wt. % to 25 wt. %, from 20 wt. % to 23 wt. %, from 23 wt. % to 50 wt. %, from 23 wt. % to 40 wt. %, from 23 wt. % to 35 wt. %, from 23 wt. % to 30 wt. %, from 23 wt. % to 28 wt. %, from 23 wt. % to 25 wt. %, from 25 wt. % to 50 wt. %, from 25 wt. % to 40 wt. %, from 25 wt. % to 35 wt. %, from 25 wt. % to 30 wt. %, from 25 wt. % to 28 wt. %, from 28 wt. % to 50 wt. %, from 28 wt. % to 40 wt. %, from 28 wt. % to 35 wt. %, from 28 wt. % to 30 wt. %, from 30 wt. % to 50 wt. %, from 30 wt. % to 40 wt. %, from 30 wt. % to 35 wt. %, from 35 wt. % to 50 wt. %, from 35 wt. % to 40 wt. %, from 40 to 50 wt. %, or approximately 24 wt. % $C_3H_8S_2$ by weight of the disulfide oil composition 205. In embodiments, $C_3H_8S_2$ may include methyl ethyl disulfide.

The disulfide oil composition 205 may include from 10 wt. % to 50 wt. %, from 10 wt. % to 40 wt. %, from 10 wt. % to 35 wt. %, from 10 wt. % to 30 wt. %, from 10 wt. % to 28 wt. %, from 10 wt. % to 26 wt. %, from 10 wt. % to 23 wt. %, from 10 wt. % to 20 wt. %, from 10 wt. % to 15 wt. %, from 15 wt. % to 50 wt. %, from 15 wt. % to 40 wt. %, from 15 wt. % to 35 wt. %, from 15 wt. % to 30 wt. %, from 15 wt. % to 28 wt. %, from 15 wt. % to 26 wt. %, from 15 wt. % to 23 wt. %, from 15 wt. % to 20 wt. %, from 20 wt. % to 50 wt. %, from 20 wt. % to 40 wt. %, from 20 wt. % to 35 wt. %, from 20 wt. % to 30 wt. %, from 20 wt. % to 28 wt. %, from 20 wt. % to 26 wt. %, from 20 wt. % to 23 wt. %, from 23 wt. % to 50 wt. %, from 23 wt. % to 40 wt. %, from 23 wt. % to 35 wt. %, from 23 wt. % to 30 wt. %, from 23 wt. % to 28 wt. %, from 23 wt. % to 26 wt. %, from 26 wt. % to 50 wt. %, from 26 wt. % to 40 wt. %, from 26 wt. % to 35 wt. %, from 26 wt. % to 30 wt. %, from 26 wt. % to 28 wt. %, from 28 wt. % to 50 wt. %, from 28 wt. % to 40 wt. %, from 28 wt. % to 35 wt. %, from 28 wt. % to 30 wt. %, from 30 wt. % to 50 wt. %, from 30 wt. % to 40 wt. %, from 30 wt. % to 35 wt. %, from 35 wt. % to 50 wt. %, from 35 wt. % to 40 wt. %, from 40 to 50 wt. %, or approximately 27 wt. % $C_4H_{10}S_2$ by weight of the disulfide oil composition 205. In embodiments, $C_4H_{10}S_2$ may include methyl isopropyl disulfide, diethyl disulfide, methyl n-propyl disulfide, or combinations thereof.

The disulfide oil composition 205 may include from 5 wt. % to 50 wt. %, from 5 wt. % to 25 wt. %, from 5 wt. % to 23 wt. %, from 5 wt. % to 20 wt. %, from 5 wt. % to 18 wt. %, from 5 wt. % to 16 wt. %, from 5 wt. % to 14 wt. %, from 5 wt. % to 12 wt. %, from 5 wt. % to 10 wt. %, from 10 wt. % to 50 wt. %, from 10 wt. % to 25 wt. %, from 10 wt. % to 23 wt. %, from 10 wt. % to 20 wt. %, from 10 wt. % to 18 wt. %, from 10 wt. % to 16 wt. %, from 10 wt. % to 14 wt. %, from 10 wt. % to 12 wt. %, from 12 wt. % to 50 wt. %, from 12 wt. % to 25 wt. %, from 12 wt. % to 23 wt. %, from 12 wt. % to 20 wt. %, from 12 wt. % to 18 wt. %, from 12 wt. % to 16 wt. %, from 12 wt. % to 14 wt. %, from 14 wt. % to 50 wt. %, from 14 wt. % to 25 wt. %, from 14 wt. % to 23 wt. %, from 14 wt. % to 20 wt. %, from 14 wt. % to 18 wt. %, from 14 wt. % to 16 wt. %, from 16 wt. % to 50 wt. %, from 16 wt. % to 25 wt. %, from 16 wt. % to 23 wt. %, from 16 wt. % to 20 wt. %, from 16 wt. % to 18 wt. %, from 18 wt. % to 50 wt. %, from 18 wt. % to 25 wt. %, from 18 wt. % to 23 wt. %, from 18 wt. % to 20 wt. %, from 20 wt. % to 50 wt. %, from 20 wt. % to 25 wt. %, from 20 wt. % to 23 wt. %, from 23 wt. % to 50 wt. %, from 23 wt. % to 25 wt. %, from 25 wt. % wt. % to 50 wt. %, or approximately 15 wt. % $C_5H_{12}S_2$ by weight of the disulfide oil composition 205 by weight of the disulfide oil composition 205. In embodiments, $C_5H_{12}S_2$ may include ethyl n-propyl disulfide, ethyl isopropyl disulfide, or both.

The disulfide oil composition 205 may include from 1 wt. % to 20 wt. %, from 1 wt. % to 15 wt. %, from 1 wt. % to 10 wt. %, from 1 wt. % to 8 wt. %, from 1 wt. % to 6 wt. %, from 1 wt. % to 4 wt. %, from 1 wt. % to 2 wt. %, from 2 wt. % to 20 wt. %, from 2 wt. % to 15 wt. %, from 2 wt. % to 10 wt. %, from 2 wt. % to 8 wt. %, from 2 wt. % to 6 wt. %, from 2 wt. % to 4 wt. %, from 4 wt. % to 20 wt. %, from 4 wt. % to 15 wt. %, from 4 wt. % to 10 wt. %, from 4 wt. % to 8 wt. %, from 4 wt. % to 6 wt. %, from 6 wt. % to 20 wt. %, from 6 wt. % to 15 wt. %, from 6 wt. % to 10 wt. %, from 6 wt. % to 8 wt. %, from 8 wt. % to 20 wt. %, from 8 wt. % to 15 wt. %, from 8 wt. % to 10 wt. %, from 10 wt. % to 20 wt. %, from 10 wt. % to 15 wt. %, from 15 wt. % to 20 wt. %, or approximately 5 wt. % $C_6H_{14}S_2$ by weight of the disulfide oil composition 205. In embodiments, $C_6H_{14}S_2$ may include di-isopropyl disulfide, di-propyl disulfide, ethyl n-butyl disulfide, or combinations thereof.

The disulfide oil composition 205 may include from 1 wt. % to 30 wt. %, from 1 wt. % to 25 wt. %, from 1 wt. % to 20 wt. %, from 1 wt. % to 18 wt. %, from 1 wt. % to 16 wt. %, from 1 wt. % to 14 wt. %, from 1 wt. % to 12 wt. %, from 1 wt. % to 10 wt. %, from 1 wt. % to 5 wt. %, from 5 wt. % to 30 wt. %, from 5 wt. % to 25 wt. %, from 5 wt. % to 20 wt. %, from 5 wt. % to 18 wt. %, from 5 wt. % to 16 wt. %, from 5 wt. % to 14 wt. %, from 5 wt. % to 12 wt. %, from 5 wt. % to 10 wt. %, from 10 wt. % to 30 wt. %, from 10 wt. % to 25 wt. %, from 10 wt. % to 20 wt. %, from 10 wt. % to 18 wt. %, from 10 wt. % to 16 wt. %, from 10 wt. % to 14 wt. %, from 10 wt. % to 12 wt. %, from 12 wt. % to 30 wt. %, from 12 wt. % to 25 wt. %, from 12 wt. % to 20 wt. %, from 12 wt. % to 18 wt. %, from 12 wt. % to 16 wt. %, from 12 wt. % to 14 wt. %, from 14 wt. % to 30 wt. %, from 14 wt. % to 25 wt. %, from 14 wt. % to 20 wt. %, from 14 wt. % to 18 wt. %, from 14 wt. % to 16 wt. %, from 16 wt. % to 30 wt. %, from 16 wt. % to 25 wt. %, from 16 wt. % to 20 wt. %, from 16 wt. % to 18 wt. %, from 18 wt. % to 30 wt. %, from 18 wt. % to 25 wt. %, from 18 wt. % to 20 wt. %, from 20 wt. % to 30 wt. %, from 20 wt. % to 25 wt. %, from 25 wt. % wt. % to 30 wt. %, or approximately 15 wt. % NaOH and water combined by weight of the disulfide oil composition 205.

As shown in FIG. 2, the disulfide oil composition 205 may be pressurized in disulfide pump 212 to create pressurized disulfide oil composition 216. The pressure of pressurized disulfide oil composition 216 may be at least 22.1 megapascals (MPa), which is approximately the critical pressure of water. Alternatively, the pressure of the pressurized disulfide oil composition 216 may be between 23 MPa and 35 MPa, or between 24 MPa and 30 MPa. For instance, the pressure of the pressurized disulfide oil composition 216 may be between 25 MPa and 29 MPa, 26 MPa and 28 MPa, 25 MPa and 30 MPa, 26 MPa and 29 MPa, or 24 MPa and 28 MPa.

The pressurized disulfide oil composition 216 may then be heated in one or more disulfide pre-heaters 220 to form pressurized, heated disulfide oil composition 224. In one embodiment, the pressurized, heated disulfide oil composition 224 has a pressure greater than the critical pressure of water and a temperature greater than 75° C. The temperature of the pressurized, heated disulfide oil composition 224 may be between 10° C. and 300° C., or between 50° C. and 250° C., or between 75° C. and 225° C., or between 100° C. and 200° C., or between 140° C. and 200° C., or between 160° C. and 200° C. The temperature of the pressurized, heated disulfide oil composition 224 may be from 100° C. to 300° C., from 100° C. to 250° C., from 100° C. to 200° C., from 100° C. to 190° C., from 100° C. to 180° C., from 100° C. to 170° C., from 100° C. to 160° C., from 100° C. to 150° C., from 150° C. to 300° C., from 150° C. to 250° C., from 150° C. to 200° C., from 150° C. to 190° C., from 150° C. to 180° C., from 150° C. to 170° C., from 150° C. to 160° C., from 160° C. to 300° C., from 160° C. to 250° C., from 160° C. to 200° C., from 160° C. to 190° C., from 160° C. to 180° C., from 160° C. to 170° C., from 170° C. to 300° C., from 170° C. to 250° C., from 170° C. to 200° C., from 170° C. to 190° C., from 170° C. to 180° C., from 180° C. to 300° C., from 180° C. to 250° C., from 180° C. to 200° C., from 180° C. to 190° C., from 190° C. to 300° C., from 190° C. to 250° C., from 190° C. to 200° C., from 200° C. to 300° C., from 200° C. to 250° C., or from 250° C. to 300° C. Without intending to be bound by theory, the disulfide oil is a light material and does not require high heat to be mixed with water; therefore, it may be desirable to heat it at or below 180° C. Heating above 180° C. may consume unnecessary energy and may cause undesirable evaporation of the disulfide oil before it is mixed with water and cause operation difficulties. It is contemplated that it may be important to keep the oil and water in liquid phase for better mixing. Heating below 100° C. may result in difficult mixing and induce oil and water phase separation. It is important to heat up the combined feedstock stream 232 after the mixer 130 close to water critical temperature (374° C.) by heat exchanger, or an electric heater or any type of heater (not shown in the FIG. 2) to avoid quenching the inlet of the supercritical water hydrogenation reactor 150 and to assure that the reactions inside the reactor 150 are taking place at water supercritical conditions.

Similar to water pre-heater 122 and hydrogen pre-heaters 128, suitable disulfide pre-heaters 220 may include a natural gas fired heater, a heat exchanger, and an electric heater. The disulfide pre-heater 220 may be a unit separate and independent from the water pre-heater 122 and the hydrogen pre-heater 128.

The heated water stream 126, the heated hydrogen stream 129, and the pressurized, heated disulfide oil composition 224 may then be mixed in feed mixer 130 to produce a combined disulfide feed stream 232. The feed mixer 130 can be any type of mixing device capable of mixing the heated water stream 126 and the pressurized, heated disulfide oil composition 224. In one embodiment, the feed mixer 130 may be a mixing tee. The feed mixer 130 may be an ultrasonic device, a small continuous stir tank reactor (CSTR), or any suitable mixer. The volumetric flow ratio of each component fed to the feed mixer 130 may vary. In embodiments, the volumetric flow ratio of the heated disulfide oil composition 224 to the heated water stream 126 may be from 1:10 to 1:1, from 1:10 to 1:5, from 1:10 to 1:2, from 1:5 to 1:1, from 1:5 to 1:2, or from 1:2 to 1:1 at standard ambient temperature and ambient pressure (SATP). In embodiments, the hydrogen-to-oil volumetric flow can be from 10 to 5000 cubic feet of heated hydrogen stream 129 to one barrel of heated disulfide oil composition 224, at SATP.

The combined disulfide feed stream 232 may then be introduced to the supercritical water hydrogenation reactor 150 configured to upgrade the combined feed stream 232. The supercritical water hydrogenation reactor 150 may be substantially similar to the supercritical water hydrogenation reactor 150 as previously described. In the supercritical water hydrogenation reactor 150 the disulfide oil and hydrogen are dissolved in the supercritical water where C—S, H—H, and S—S bonds are broken and the generated hydrocarbon and heteroatoms radicals are saturated.

Referring to FIG. 2, upon exiting the supercritical water hydrogenation reactor 150, the upgraded disulfide product 252 may be cooled by cooler 154 to a temperature from 20° C. to 50° C., from 20° C. to 40° C., from 20° C. to 30° C., from 30° C. to 50° C., from 30° C. to 40° C., or from 40° C. to 50° C. to form a cooled, upgraded disulfide product 256.

Upon exiting the cooler 154, the pressure of the cooled, upgraded disulfide product 256 may be reduced to create a depressurized, upgraded disulfide product 259, which may have a pressure from 0.01 MPa to 1.0 MPa, from 0.01 MPa to 0.8 MPa, from 0.01 MPa to 0.5 MPa, from 0.01 MPa to 0.3 MPa, from 0.01 MPa to 0.1 MPa, from 0.01 MPa to 0.08 MPa, from 0.01 MPa to 0.05 MPa, from 0.01 MPa to 0.03 MPa, from 0.03 MPa to 1.0 MPa, from 0.03 MPa to 0.8 MPa, from 0.03 MPa to 0.5 MPa, from 0.03 MPa to 0.3 MPa, from 0.03 MPa to 0.1 MPa, from 0.03 MPa to 0.08 MPa, from 0.03 MPa to 0.05 MPa, from 0.05 MPa to 1.0 MPa, from 0.05 MPa to 0.8 MPa, from 0.05 MPa to 0.5 MPa, from 0.05 MPa to 0.3 MPa, from 0.05 MPa to 0.1 MPa, from 0.05 MPa to 0.08 MPa, from 0.08 MPa to 1.0 MPa, from 0.08 MPa to 0.8 MPa, from 0.08 MPa to 0.5 MPa, from 0.08 MPa to 0.3 MPa, from 0.08 MPa to 0.1 MPa, from 0.1 MPa to 1.0 MPa, from 0.1 MPa to 0.8 MPa, from 0.1 MPa to 0.5 MPa, from 0.1 MPa to 0.3 MPa, from 0.3 MPa to 1.0 MPa, from 0.3 MPa to 0.8 MPa, from 0.3 MPa to 0.5 MPa, from 0.5 MPa to 1.0 MPa, from 0.5 MPa to 0.8 MPa, or from 0.8 MPa to 1.0 MPa. The depressurizing can be achieved by many devices, for example, a valve 158 as shown in FIGS. 1 and 2.

The depressurized, upgraded disulfide product 259 may then be passed to a gas/water separator 160. The gas/water separator 160 may separate the depressurized, upgraded disulfide product 259 into a second gas fraction 264 and a second water fraction 266. The gas/water separator 160 may be any separator known in the industry. While the gas/water separator 160 may separate the depressurized, upgraded disulfide product 259 into at least a second gas fraction 264 and a second water fraction 266, it should be appreciated that additional fractions may also be produced. The second gas fraction 264 may be passed to the gas storage tank 165 and the second water fraction 266 may be passed to the water storage tank 167. In embodiments, the percent conversion of the disulfide oil composition 205 may be from 50% to 99%, from 50% to 95%, from 50% to 90%, from 50% to 85%, from 50% to 82%, from 60% to 99%, from 60% to 95%, from 60% to 90%, from 60% to 85%, from 60% to 82%, from 70% to 99%, from 70% to 95%, from 70% to 90%, from 70% to 85%, from 70% to 82%, from 75% to 99%, from 75% to 95%, from 75% to 90%, from 75% to 85%, from 75% to 82%, from 78% to 99%, from 78% to 95%, from 78% to 90%, from 78% to 85%, from 78% to 82%, or approximately 80%.

In embodiments, the second gas fraction 264 may include $H_2$, $C_2H_6$, $C_3H_8$, $C_4H_{10}$, $C_5H_{12}$, $C_6H_{14}$, $CH_3SH$, $C_2H_5SH$, $C_4H_9SH$, $C_5H_{11}SH$, $H_2S$, $C_2H_6S_2$, $C_3H_8S_2$, $C_4H_{10}S_2$, $C_5H_{12}S_2$, $C_6H_{14}S_2$, or combinations thereof.

The second gas fraction 264 may include from 0.1 wt. % to 0.5 wt. %, from 0.1 wt. % to 0.4 wt. %, from 0.1 wt. % to 0.3 wt. %, from 0.1 wt. % to 0.2 wt. %, from 0.2 wt. % to 0.5 wt. %, from 0.2 wt. % to 0.4 wt. %, from 0.2 wt. % to 0.3 wt. %, from 0.3 wt. % to 0.5 wt. %, from 0.3 wt. % to 0.4 wt. %, from 0.4 wt. % to 0.5 wt. %, or approximately 0.3 wt. % $H_2$ by weight of the second gas fraction 264.

The second gas fraction 264 may include from 1 wt. % to 13 wt. %, from 1 wt. % to 10 wt. %, from 1 wt. % to 7 wt. %, from 1 wt. % to 5 wt. %, from 1 wt. % to 3 wt. %, from 1 wt. % to 2 wt. %, from 2 wt. % to 13 wt. %, from 2 wt. % to 10 wt. %, from 2 wt. % to 7 wt. %, from 2 wt. % to 5 wt. %, from 2 wt. % to 3 wt. %, from 3 wt. % to 13 wt. %, from 3 wt. % to 10 wt. %, from 3 wt. % to 7 wt. %, from 3 wt. % to 5 wt. %, from 5 wt. % to 13 wt. %, from 5 wt. % to 10 wt. %, from 5 wt. % to 7 wt. %, from 7 wt. % to 13 wt. %, from 7 wt. % to 10 wt. %, from 10 wt. % to 13 wt. %, or approximately 4 wt. % $C_2H_6$ by weight of the second gas fraction 264.

The second gas fraction 264 may include from 5 wt. % to 20 wt. %, from 5 wt. % to 18 wt. %, from 5 wt. % to 15 wt. %, from 5 wt. % to 13 wt. %, from 5 wt. % to 11 wt. %, from 5 wt. % to 8 wt. %, from 8 wt. % to 20 wt. %, from 8 wt. % to 18 wt. %, from 8 wt. % to 15 wt. %, from 8 wt. % to 13 wt. %, from 8 wt. % to 11 wt. %, from 11 wt. % to 20 wt. %, from 11 wt. % to 18 wt. %, from 11 wt. % to 15 wt. %, from 11 wt. % to 13 wt. %, from 13 wt. % to 20 wt. %, from 13 wt. % to 18 wt. %, from 13 wt. % to 15 wt. %, from 15 wt. % to 20 wt. %, from 15 wt. % to 18 wt. %, from 18 wt. % to 20 wt. %, or approximately 12 wt. % $C_3H_8$ by weight of the second gas fraction 264.

The second gas fraction 264 may include from 5 wt. % to 30 wt. %, from 5 wt. % to 23 wt. %, from 5 wt. % to 20 wt. %, from 5 wt. % to 18 wt. %, from 5 wt. % to 16 wt. %, from 5 wt. % to 14 wt. %, from 5 wt. % to 12 wt. %, from 5 wt. % to 10 wt. %, from 10 wt. % to 30 wt. %, from 10 wt. % to 23 wt. %, from 10 wt. % to 20 wt. %, from 10 wt. % to 18 wt. %, from 10 wt. % to 16 wt. %, from 10 wt. % to 14 wt. %, from 10 wt. % to 12 wt. %, from 12 wt. % to 30 wt. %, from 12 wt. % to 23 wt. %, from 12 wt. % to 20 wt. %, from 12 wt. % to 18 wt. %, from 12 wt. % to 16 wt. %, from 12 wt. % to 14 wt. %, from 14 wt. % to 30 wt. %, from 14 wt. % to 23 wt. %, from 14 wt. % to 20 wt. %, from 14 wt. % to 18 wt. %, from 14 wt. % to 16 wt. %, from 16 wt. % to 30 wt. %, from 16 wt. % to 23 wt. %, from 16 wt. % to 20 wt. %, from 16 wt. % to 18 wt. %, from 18 wt. % to 30 wt. %, from 18 wt. % to 23 wt. %, from 18 wt. % to 20 wt. %, from 20 wt. % to 30 wt. %, from 20 wt. % to 23 wt. %, from 23 wt. % to 30 wt. %, or approximately 15 wt. % $C_4H_{10}$ by weight of the second gas fraction 264.

The second gas fraction 264 may include from 1 wt. % to 20 wt. %, from 1 wt. % to 15 wt. %, from 1 wt. % to 10 wt. %, from 1 wt. % to 8 wt. %, from 1 wt. % to 6 wt. %, from 1 wt. % to 4 wt. %, from 1 wt. % to 2 wt. %, from 2 wt. % to 20 wt. %, from 2 wt. % to 15 wt. %, from 2 wt. % to 10 wt. %, from 2 wt. % to 8 wt. %, from 2 wt. % to 6 wt. %, from 2 wt. % to 4 wt. %, from 4 wt. % to 20 wt. %, from 4 wt. % to 15 wt. %, from 4 wt. % to 10 wt. %, from 4 wt. % to 8 wt. %, from 4 wt. % to 6 wt. %, from 6 wt. % to 20 wt. %, from 6 wt. % to 15 wt. %, from 6 wt. % to 10 wt. %, from 6 wt. % to 8 wt. %, from 8 wt. % to 20 wt. %, from 8 wt. % to 15 wt. %, from 8 wt. % to 10 wt. %, from 10 wt.

% to 20 wt. %, from 10 wt. % to 15 wt. %, from 15 wt. % to 20 wt. %, or approximately 5 wt. % $C_5H_{12}$ by weight of the second gas fraction 264.

The second gas fraction 264 may include from 0.5 wt. % to 5 wt. %, from 0.5 wt. % to 3.5 wt. %, from 0.5 wt. % to 3.0 wt. %, from 0.5 wt. % to 2.5 wt. %, from 0.5 wt. % to 2.2 wt. %, from 0.5 wt. %, to 1.8 wt. %, from 0.5 wt. % to 1.5 wt. %, from 0.5 wt. % to 1.0 wt. %, from 1.0 wt. % to 5 wt. %, from 1.0 wt. % to 3.5 wt. %, from 1.0 wt. % to 3.0 wt. %, from 1.0 wt. % to 2.5 wt. %, from 1.0 wt. % to 2.2 wt. %, from 1.0 wt. %, to 1.8 wt. %, from 1.0 wt. % to 1.5 wt. %, from 1.5 wt. % to 5 wt. %, from 1.5 wt. % to 3.5 wt. %, from 1.5 wt. % to 3.0 wt. %, from 1.5 wt. % to 2.5 wt. %, from 1.5 wt. % to 2.2 wt. %, from 1.5 wt. %, to 1.8 wt. %, from 1.8 wt. % to 5 wt. %, from 1.8 wt. % to 3.5 wt. %, from 1.8 wt. % to 3.0 wt. %, from 1.8 wt. % to 2.5 wt. %, from 1.8 wt. % to 2.2 wt. %, from 2.2 wt. % to 5 wt. %, from 2.2 wt. % to 3.5 wt. %, from 2.2 wt. % to 3.0 wt. %, from 2.2 wt. % to 2.5 wt. %, from 2.5 wt. % to 5 wt. %, from 2.5 wt. % to 3.5 wt. %, from 2.5 wt. % to 3.0 wt. %, from 3.0 wt. % to 5 wt. %, from 3.0 to 3.5 wt. %, from 3.5 to 5 wt. %, or approximately 2 wt. % $C_6H_{14}$ by weight of the second gas fraction 264.

The second gas fraction 264 may include from 8 to 58 wt. %, from 8 to 50 wt. %, from 8 to 40 wt. %, from 8 to 30 wt. %, from 8 to 20 wt. %, from 8 to 15 wt. %, from 8 to 10 wt. %, from 10 to 58 wt. %, from 10 to 50 wt. %, from 10 to 40 wt. %, from 10 to 30 wt. %, from 10 to 20 wt. %, from 10 to 15 wt. %, from 15 to 58 wt. %, from 15 to 50 wt. %, from 15 to 40 wt. %, from 15 to 30 wt. %, from 15 to 20 wt. %, from 20 to 58 wt. %, from 20 to 50 wt. %, from 20 to 40 wt. %, from 20 to 30 wt. %, from 30 to 58 wt. %, from 30 to 50 wt. %, from 30 to 40 wt. %, from 40 to 58 wt. %, from 40 to 50 wt. %, from 50 to 58 wt. %, or approximately 35 wt. % $H_2S$ by weight of the second gas fraction 264.

The second gas fraction 264 may include from 1 wt. % to 5 wt. %, from 1 wt. % to 4 wt. %, from 1 wt. % to 3.5 wt. %, from 2 wt. % to 5 wt. %, from 2 wt. % to 4 wt. %, from 2 wt. % to 3.5 wt. %, from 2.5 wt. % to 5 wt. %, from 2.5 wt. % to 4 wt. %, from 2.5 wt. % to 3.5 wt. %, or approximately 3 wt. % $CH_3SH$ by weight of the second gas fraction 264.

The second gas fraction 264 may include from 0.5 wt. % to 4 wt. %, from 0.5 wt. % to 3 wt. %, from 0.5 wt. % to 2.5 wt. %, from 1 wt. % to 4 wt. %, from 1 wt. % to 3 wt. %, from 1 wt. % to 2.5 wt. %, from 1.5 wt. % to 4 wt. %, from 1.5 wt. % to 3 wt. %, from 1.5 wt. % to 2.5 wt. %, or approximately 2 wt. % $C_2H_5SH$ by weight of the second gas fraction 264.

The second gas fraction 264 may include from 0.25 wt. % to 2 wt. %, from 0.25 wt. % to 1.5 wt. %, from 0.25 wt. % to 1.25 wt. %, from 0.5 wt. % to 2 wt. %, from 0.5 wt. % to 1.5 wt. %, from 0.5 wt. % to 1.25 wt. %, from 0.75 wt. % to 2 wt. %, from 0.75 wt. % to 1.5 wt. %, from 0.75 wt. % to 1.25 wt. %, or approximately 1 wt. % $C_4H_9SH$ by weight of the second gas fraction 264.

The second gas fraction 264 may include from 0.25 wt. % to 2 wt. %, from 0.25 wt. % to 1.5 wt. %, from 0.25 wt. % to 1.25 wt. %, from 0.5 wt. % to 2 wt. %, from 0.5 wt. % to 1.5 wt. %, from 0.5 wt. % to 1.25 wt. %, from 0.75 wt. % to 2 wt. %, from 0.75 wt. % to 1.5 wt. %, from 0.75 wt. % to 1.25 wt. %, or approximately 1 wt. % $C_5H_{11}SH$ by weight of the second gas fraction 264.

The second gas fraction 264 may include from 1 wt. % to 5 wt. %, from 1 wt. % to 4 wt. %, from 1 wt. % to 3.5 wt. %, from 2 wt. % to 5 wt. %, from 2 wt. % to 4 wt. %, from 2 wt. % to 3.5 wt. %, from 2.5 wt. % to 5 wt. %, from 2.5 wt. % to 4 wt. %, from 2.5 wt. % to 3.5 wt. %, or approximately 3 wt. % $C_2H_6S_2$ by weight of the second gas fraction 264.

The second gas fraction 264 may include from 1 wt. % to 10 wt. %, from 1 wt. % to 8 wt. %, from 1 wt. % to 7 wt. %, from 3 wt. % to 10 wt. %, from 3 wt. % to 8 wt. %, from 3 wt. % to 7 wt. %, from 5 wt. % to 10 wt. %, from 5 wt. % to 8 wt. %, from 5 wt. % to 7 wt. %, or approximately 6 wt. % $C_3H_8S_2$ by weight of the second gas fraction 264.

The second gas fraction 264 may include from 1 wt. % to 10 wt. %, from 1 wt. % to 8 wt. %, from 1 wt. % to 7 wt. %, from 3 wt. % to 10 wt. %, from 3 wt. % to 8 wt. %, from 3 wt. % to 7 wt. %, from 5 wt. % to 10 wt. %, from 5 wt. % to 8 wt. %, from 5 wt. % to 7 wt. %, or approximately 6 wt. % $C_4H_{10}S_2$ by weight of the second gas fraction 264.

The second gas fraction 264 may include from 1 wt. % to 5 wt. %, from 1 wt. % to 4 wt. %, from 1 wt. % to 3.5 wt. %, from 2 wt. % to 5 wt. %, from 2 wt. % to 4 wt. %, from 2 wt. % to 3.5 wt. %, from 2.5 wt. % to 5 wt. %, from 2.5 wt. % to 4 wt. %, from 2.5 wt. % to 3.5 wt. %, or approximately 3 wt. % $C_5H_{12}S_2$ by weight of the second gas fraction 264.

The second gas fraction 264 may include from 0.25 wt. % to 2 wt. %, from 0.25 wt. % to 1.5 wt. %, from 0.25 wt. % to 1.25 wt. %, from 0.5 wt. % to 2 wt. %, from 0.5 wt. % to 1.5 wt. %, from 0.5 wt. % to 1.25 wt. %, from 0.75 wt. % to 2 wt. %, from 0.75 wt. % to 1.5 wt. %, from 0.75 wt. % to 1.25 wt. %, or approximately 1 wt. % $C_6H_{14}S_2$ by weight of the second gas fraction 264.

In embodiments, the second gas fraction 264 may have a similar composition to liquefied petroleum gas (LPG), due to the presence of butane and propane. In embodiments, the second gas fraction 264 may have a composition similar to LPG+, meaning that the second gas fraction 264 includes components present in LPG (butane and propane) along with additional liquid components, such as a pentane and hexane. Therefore, the process 200 as shown in FIG. 2 may be used to convert hazardous waste, such as disulfide oil, into desirable products, such as Hz, $C_2$ to $C_6$ hydrocarbons, $H_2S$, or combinations thereof.

EXAMPLES

Example 1

An example process for upgrading a hydrocarbon-based composition 105 according to embodiments described herein was run. The hydrocarbon-based composition 105 had the properties shown in Table 2.

TABLE 2

Properties of Feed and Product

| Properties | | Hydro carbon-based composition (105) | Upgraded Product (152) | Liquid Oil Fraction (162) |
|---|---|---|---|---|
| Mass Flow (kg/hr) | | 49 | 48.1 | 45.6 |
| API° | | 11 | 19.8 | 24 |
| Hydrogen Flow (kg/hr) | | 0.4 | 0.0 | 0.0 |
| Distillation (TBP) | 5% | 367 | 297 | 256 |
| | 10% | 395 | 337 | 300 |
| | 30% | 465 | 420 | 374 |
| | 50% | 526 | 464 | 415 |
| | 70% | 587 | 519 | 461 |
| | 90% | 647 | 592 | 538 |

TABLE 2-continued

| Properties of Feed and Product | | | |
|---|---|---|---|
| Properties | Hydro carbon-based composition (105) | Upgraded Product (152) | Liquid Oil Fraction (162) |
| 95% | 671 | 632 | 568 |
| Total Sulfur Content (wt. %) | 3.4 | 2.7 | 1.7 |
| Total Nitrogen Content (wt. %) | 1.2 | 0.9 | 0.3 |
| Viscosity (cSt) at 50° C. | 640 | 89 | 27 |
| Asphaltene (Heptane-insoluble) (wt. %) | 4.8 | 1.7 | 0.3 |
| Metals (V and Ni) (wtppm) | 83 | 9 | 4 |
| Water (wt. %) | 0 | 0.2 | 0 |

kg/hr
Sulfur in Feed = 1.7
Nitrogen in Feed = 0.6
Sulfur in Liquid Product = 0.8
Nitrogen in Liquid Product = 0.1

A water stream 110 included demineralized water having a conductivity of less than 0.1 μS/cm$^2$. The hydrocarbon-based composition 105, the water stream 110, and a hydrogen stream 127 were fed at rates of 50 L/hr, 100 L/hr, and 157 ft$^3$/hr, respectively, at a process pressure of 3,600 psig.

As shown in FIG. 1, the hydrocarbon-based composition 105 and the water stream 110 are fed to pumps 112 and 114, respectively, to increase their pressure to 3600 psig. The pressurized hydrocarbon-based composition 116, pressurized water stream 118, and hydrogen stream 127 are heated to about 350° C. by heaters 120, 122, and 128, respectively. The pressurized, heated hydrocarbon-based composition 124, the heated water stream 126, and the heated hydrogen stream 129 exiting the heaters were routed to a static mixer 130, where the hydrogen, oil, and water are mixed vigorously to generate combined feed stream 132. The combined feed stream 132 is then routed to the supercritical water hydrogenation reactor 150 that is configured to upgrade the combined feed stream 132 that is maintained at 440° C. and 3600 psig. The upgraded product 152 having the properties shown in Table 2 was routed to cooler 154 to form a cooled, upgraded product 156. The cooled, upgraded product 156 was depressurized by valve 158 to reduce the mixture pressure to 1 atm to form a depressurized, upgraded product 159. The depressurized, upgraded product 159 was then sent to a gas/oil/water separator 160 to separate the depressurized, upgraded product 159 into a first gas fraction 164, a liquid oil fraction 162, and a first water fraction 166. The liquid oil fraction 162 had the properties shown in Table 2. The liquid oil fraction 162 was then collected in an oil storage tank 163. The composition of the first gas fraction 164 is shown in Table 3:

TABLE 3

| First Gas Fraction 164<br>First Gas Fraction 164 | | | | |
|---|---|---|---|---|
| Species | Concentration (wt. %) | MW (kg/kmol) | kg/hr | kmol/hr |
| $H_2$ | 1.0 | 2.0 | 0.04 | 0.02 |
| $CH_4$ | 11.9 | 16.0 | 0.45 | 0.03 |
| $C_2H_6$ | 10.9 | 30.1 | 0.41 | 0.01 |
| $C_3H_8$ | 10.0 | 44.1 | 0.38 | 0.01 |
| $C_4H_{10}$ | 9.0 | 58.1 | 0.34 | 0.01 |

TABLE 3-continued

| First Gas Fraction 164<br>First Gas Fraction 164 | | | | |
|---|---|---|---|---|
| Species | Concentration (wt. %) | MW (kg/kmol) | kg/hr | kmol/hr |
| $C_5H_{12}$ | 7.0 | 72.2 | 0.26 | 0.00 |
| $C_6H_{14}$ | 4.0 | 86.2 | 0.15 | 0.00 |
| CO | 2.0 | 28.0 | 0.08 | 0.00 |
| $CO_2$ | 4.0 | 44.0 | 0.15 | 0.00 |
| $H_2S$ | 25.6 | 34.1 | 0.97 | 0.03 |
| $NH_3$ | 14.6 | 17.0 | 0.55 | 0.03 |

kg/hr
Sulfur in Gas Product = 0.9
Nitrogen in Gas Product = 0.5

Example 2

An example process for treating disulfide oil according to embodiments described herein was run. A disulfide oil stream of 180 kg/hr exiting LPG Merox is hydrotreated in supercritical water to remove the sulfur in the form of $H_2S$. The disulfide oil composition 205 had the composition shown in Table 4:

TABLE 4

| Disulfide Oil Composition 205 | | | | |
|---|---|---|---|---|
| Species | Concentration (wt. %) | kg/hr | MW (kg/kmol) | kmol/hr |
| $C_2H_6S_2$ | 14 | 23 | 94 | 0.24 |
| $C_3H_8S_2$ | 24 | 39 | 108 | 0.36 |
| $C_4H_{10}S_2$ | 27 | 44 | 122 | 0.36 |
| $C_5H_{12}S_2$ | 15 | 24 | 136 | 0.18 |
| $C_6H_{14}S_2$ | 5 | 8 | 150 | 0.05 |
| NaOH + water | 15 | 24 | | |
| Total | 100 | 162 | | |
| Total Feed (Excluding NaOH + water) (kg/hr) = | | 139 | | |

The disulfide oil composition 205 included 2.4 kilomoles per hour (kmol/hr) of sulfur. The flow rate of the total feed excluding NaOH and water was 139 kilograms per hour (kg/hr). The water stream 110 was demineralized water having a conductivity lower than 0.1 μS/cm$^2$. The disulfide oil composition 205 and the water stream 110 were fed to pumps 212 and 114, respectively, to increase their pressure to a pressure of 3600 psi to form pressurized disulfide composition 216 and pressurized water stream 118, respectively. The pressurized disulfide oil composition 216, the pressurized water stream 118, and the hydrogen stream 127 were fed to the process at rates of 162 kg/hr, 360 L/hr, and 500 ft$^3$/hr, respectively. The pressurized disulfide oil composition 216, the pressurized water stream 118, and the hydrogen stream 127 were preheated by heaters 220, 122, and 128, respectively, to a temperature of 180° C., to form pressurized, heated disulfide oil composition 224, heated water stream 126, and heated hydrogen stream 129. The heated water stream 126, the heated hydrogen stream 129, and the pressurized, heated disulfide oil composition 224 were then mixed in a static mixer 130 to produce a combined disulfide feed stream 232. The combined disulfide feed stream 232 was then introduced to the supercritical water hydrogenation reactor 150. The disulfide oil was then hydrotreated in the supercritical water hydrogenation reactor 150 at 450° C. and 3600 psig (24.8 MPa) to form upgraded disulfide product 252. Upon exiting the supercritical water hydrogenation reactor 150, the upgraded disulfide product 252 was cooled by water cooler 154 to 35° C. to form cooled, upgraded disulfide product 256. The cooled, upgraded disulfide product 256 was then depressurized to 1 atm by back pressure regulator valve 158 to form depressurized, upgraded disulfide product 259. The depressurized, upgraded disulfide product 259 was then sent to the gas/water separator 160 to separate the depressurized, upgraded disulfide product 259 into the second water fraction 266 and the second gas fraction 264. The gas/water separator 160 was operated at 1 atmosphere and a maximum of 90° C. The percent conversion of disulfide oil was 80%. The second gas fraction 264 collected in the gas storage tank 165 was a mixture of light paraffins, thiols, un-converted disulfide oil and hydrogen, and hydrogen sulfide. The composition of the second gas fraction 264 is shown in Table 5:

TABLE 5

Properties of the second gas fraction 264

| Second gas fraction 264 | | | | | Sulfur in |
|---|---|---|---|---|---|
| Species | Concentration (wt. %) | kg/hr | MW (kg/kmol) | kmol/hr | Product kmol/hr |
| $H_2$ | 0.3 | 0.3 | 2 | 0.17 | 0.6 |
| $C_2H_6$ | 4 | 4.5 | 30 | 0.15 | |
| $C_3H_8$ | 12 | 13.4 | 44 | 0.30 | |
| $C_4H_{10}$ | 15 | 16.7 | 58 | 0.29 | |
| $C_5H_{12}$ | 5 | 5.6 | 72 | 0.08 | |
| $C_6H_{14}$ | 2 | 2.2 | 86 | 0.03 | |
| $CH_3SH$ | 3 | 3.3 | 48 | 0.07 | |
| $C_2H_5SH$ | 2 | 2.2 | 62 | 0.04 | |
| $C_4H_9SH$ | 1 | 1.1 | 90 | 0.01 | |
| $C_5H_{11}SH$ | 1 | 1.1 | 104 | 0.01 | |
| $H_2S$ | 35 | 60.6 | 34 | 1.78 | |
| $C_2H_6S_2$ | 3 | 4.5 | 94 | 0.05 | |
| $C_3H_8S_2$ | 6 | 7.8 | 108 | 0.07 | |
| $C_4H_{10}S_2$ | 6 | 8.8 | 122 | 0.07 | |
| $C_5H_{12}S_2$ | 3 | 4.9 | 136 | 0.04 | |
| $C_6H_{14}S_2$ | 1 | 1.6 | 150 | 0.01 | |
| Total | 100 | 139 | Total Sulfur Out (kg/hr) = | | 76 |

It should be apparent to those skilled in the art that various modifications and variations may be made to the embodiments described within without departing from the spirit and scope of the claimed subject matter. Thus, it is intended that the specification cover the modifications and variations of the various embodiments described within provided such modifications and variations come within the scope of the appended claims and their equivalents.

As used throughout the disclosure, the singular forms "a," "an" and "the" include plural referents unless the context clearly dictates otherwise. Thus, for example, reference to "a" component includes aspects having two or more such components, unless the context clearly indicates otherwise.

Having described the subject matter of the present disclosure in detail and by reference to specific embodiments thereof, it is noted that the various details disclosed within should not be taken to imply that these details relate to elements that are essential components of the various embodiments described within, even in cases where a particular element is illustrated in each of the drawings that accompany the present description. Further, it should be apparent that modifications and variations are possible without departing from the scope of the present disclosure, including, but not limited to, embodiments defined in the appended claims. More specifically, although some aspects of the present disclosure are identified as particularly advantageous, it is contemplated that the present disclosure is not necessarily limited to these aspects.

What is claimed is:

1. A process for treating a disulfide oil composition comprising:

combining a heated water stream, a hydrogen stream, and a disulfide oil composition in a mixing device to create a combined disulfide feed stream;

introducing the combined disulfide feed stream into a supercritical water hydrogenation reactor operating at a temperature greater than a critical temperature of water and a pressure greater than a critical pressure of water; and at least partially converting the combined disulfide feed stream to an upgraded disulfide product.

2. The process of claim 1, further comprising passing the upgraded product out of the supercritical water hydrogenation reactor to a gas/water separator and separating the upgraded product in the gas/water separator to produce a gas fraction and a water fraction.

3. The process of claim 2, wherein the gas fraction is selected from the group consisting of $H_2$, $C_2$ to $C_6$ hydrocarbons, $H_2S$, and combinations thereof.

4. The process of claim 1, further comprising passing the upgraded product to a cooling device to form a cooled upgraded product.

5. The process of claim 4, further comprising passing the cooled upgraded product to a depressurizing device.

6. The process of claim 1, wherein the disulfide oil composition is selected from the group consisting of $C_2H_6S_2$, $C_3H_8S_2$, $C_4H_{10}S_2$, $C_5H_{12}S_2$, $C_6H_{14}S_2$, and combinations thereof.

7. The process of claim 1, wherein the disulfide oil compositions comprises:

from 10 wt. % to 20 wt. % $C_2H_6S_2$;

from 20 wt. % to 30 wt. % $C_3H_8S_2$;

from 20 wt. % to 35 wt. % $C_4H_{10}S_2$;

from 10 wt. % to 20 wt. % $C_5H_{12}S_2$; and from 1 wt. % to 10 wt. % $C_6H_{14}S_2$.

8. The process of claim 1, wherein the supercritical water hydrogenation reactor has a temperature of greater than 375° C. and less than 600° C. and a pressure greater than 22.1 MPa and less than 75 MPa.

9. The process of claim 1, wherein the supercritical water hydrogenation reactor has a temperature of greater than 390° C. and less than 470° C. and a pressure greater than 24 MPa and less than 30 MPa.

10. The process of claim 1, wherein the supercritical water hydrogenation reactor has a residence time of from 2 to 15 minutes.

* * * * *